US006980754B2

(12) United States Patent
Isomura et al.

(10) Patent No.: US 6,980,754 B2
(45) Date of Patent: Dec. 27, 2005

(54) TONER SUPPLY CONTAINER AND UNSEALING MEMBER FOR UNSEALING THE TONER SUPPLY CONTAINER

(75) Inventors: Tetsuo Isomura, Abiko (JP); Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/422,977

(22) Filed: Apr. 25, 2003

(65) Prior Publication Data

US 2004/0028427 A1 Feb. 12, 2004

(30) Foreign Application Priority Data

Apr. 26, 2002 (JP) ..... 2002-127694

(51) Int. Cl.[7] ..... G03G 15/08

(52) U.S. Cl. ..... 399/106; 399/263; 222/82; 222/DIG. 1

(58) Field of Search ..... 399/106, 258, 399/262, 263; 222/81–83, 541.2, 541.6, 541.7, DIG. 1; 220/265–267, 276–278

(56) References Cited

U.S. PATENT DOCUMENTS

| | | | | |
|---|---|---|---|---|
| 4,561,567 A | * | 12/1985 | Wittstein et al. | 222/83.5 |
| 5,495,323 A | * | 2/1996 | Meetze, Jr. | 399/120 |
| 5,513,679 A | | 5/1996 | Yamada | 141/364 |
| 5,520,229 A | | 5/1996 | Yamada | 141/364 |
| 5,576,816 A | * | 11/1996 | Staudt et al. | 399/262 |
| 5,595,223 A | * | 1/1997 | Hayao | 141/375 |
| 6,137,972 A | * | 10/2000 | Playfair et al. | 399/106 |
| 6,193,113 B1 | * | 2/2001 | Hidding | 222/325 |
| 6,314,261 B1 | | 11/2001 | Omata et al. | 399/258 |
| 6,628,908 B2 | * | 9/2003 | Matsumoto et al. | 399/106 |
| 2002/0031638 A1 | | 3/2002 | Yamada et al. | 428/99 |
| 2002/0106215 A1 | | 8/2002 | Ban et al. | 399/120 |
| 2002/0122676 A1 | | 9/2002 | Yamada et al. | 399/263 |
| 2002/0127029 A1 | | 9/2002 | Yamada et al. | 399/106 |

FOREIGN PATENT DOCUMENTS

JP 10020644 A * 1/1998 ..... G03G/15/08

OTHER PUBLICATIONS

U.S. Appl. No. 10/419,758, filed Apr. 22, 2003, Junko Yoshikawa, pending.
U.S. Appl. No. 10/420,735, filed Apr. 23, 2003, Tetsuo Isomura et al., pending.
U.S. Appl. No. 10/420,885, filed Apr. 23, 2003, Yataka Ban et al., pending.

* cited by examiner

*Primary Examiner*—Robert Beatty
(74) *Attorney, Agent, or Firm*—Fitzpatrick, Cella, Harper & Scinto

(57) ABSTRACT

A toner supply container detachably mountable to an image forming apparatus includes a container body for accommodating toner, a discharge opening for permitting discharge of the toner from the container body, a sheet for sealing the discharge opening and for being staved by an unsealing member provided in the image forming apparatus, and a rotational force receiving portion for receiving a rotational force for feeding the toner from the container body toward the discharge opening. After the sheet is staved by the unsealing member, the rotational force receiving portion is engaged with the unsealing member to be placed in a state capable of receiving the rotational force.

17 Claims, 21 Drawing Sheets

TONER SUPPLY CONTAINER AND UNSEALING MEMBER FOR UNSEALING THE TONER SUPPLY CONTAINER

FIELD OF THE INVENTION AND RELATED ART

The present invention relates to a toner supply container for supplying toner to an image forming apparatus which employs an electrostatic recording method or an electrophotographic method, and an unsealing member for unsealing the toner supply container.

In a conventional electrophotographic image forming apparatus such as an electrophotographic copying machine or a printer, fine particles toner is used as a developer. When the toner in a main body of the electrophotographic image forming apparatus is used up, the toner is supplied into the main assembly of the image forming apparatus by using a toner supply container.

Here, the electrophotographic image forming apparatus includes an electrophotographic copying machine, an electrophotographic printer, a facsimile machine, word processor or the like.

Since the toner is very fine powder, the toner has been accompanied with a problem such that toner particles are scattered during toner supply operation, thus resulting in contamination of an operator (user) or surroundings of the container. For this reason, there has been proposed and practiced a system in which a toner supply container is mounted in a main body of an image forming apparatus and toner is gradually discharged though a small opening of the toner supply container.

Any one of the above-described toner supply containers receives a driving force from the main body of an image forming apparatus to drive a feeding member in the toner supply container or the main body itself to discharge the toner. As for such a drive transmitting means, there are some methods. For example, there have been known methods such that gear portion is provided on an outer surface of a toner bottle (toner supply container), that end surface of the toner bottle is provided with a projection, and that a driving force is transmitted through a coupling portion of projections and grooves.

On the other hand, as a means for sealing an opening of a toner supply container, there has conventionally been ordinarily practiced a system in which a flexible film is heat-sealed to the opening of the toner supply container and a user unseals he flexible film by peeling off the flexible film with hand. Further, a method wherein a packing member is adhered to slidable shutter member which is openable and closable, and an opening of the toner supply container is sealed through the packing member, followed by pulling-out of the shutter member by a user to unseal the opening. In addition, it has been also performed that a capping member is press-fitted in an opening of the toner supply container and then the capping member is peeled out to unseal the opening.

In the conventional toner supply containers, the above-mentioned drive transmission means and the sealing means for sealing the opening are generally provided separately.

Further, in the main body of the image forming apparatus, means for transmitting a driving force to the toner supply container and means for unsealing the opening are generally provided as separate members.

However, the conventional methods have been accompanied with some technical problems.

First, in the cases of peeling-off of the flexible film heat-sealed to the opening of the toner supply container by the user and of pulling-out of the slidable shutter member, provided with the packing member for sealing the opening by the user, a considerable force is required to unseal the opening. Further, the user is required to directly operate the means for unsealing the opening. Accordingly, a heavy burden is imposed on the user and the operation itself is troublesome.

Further, as a force required for unsealing becomes larger, the toner is much liable to be scattered in response to the unsealing force, thus contaminating the user or the periphery of the main body of the image forming apparatus.

Secondly, the unsealing means for the opening and the driving force transmission means for the toner supply container are separately provided as described above. As a result, the feeding member of the toner supply container or the toner supply container itself is normally driven after the opening of the toner supply container is unsealed, but there is a possibility that the feeding member of the toner supply container or the toner supply container itself is accidentally driven without unsealing the opening, thus resulting in a state such that no toner is supplied for a while.

Thirdly, in the case where the feeding member is provided in the toner supply container and the driving force is transmitted from the apparatus main body to the feeding member by using the coupling portion of projections and grooves, the user accidentally turns the coupling portion to rotate the feeding member backward in some cases. If the feeding member is reversely rotated, the toner is pushed toward an opposite end of the opening within the toner supply container. As a result, a stress is applied to the accommodated toner, thus being capable of causing formation of bulky particles etc.

SUMMARY OF THE INVENTION

An object of the present invention is to provide a toner supply container improved in usability.

Another object of the present invention is to provide an unsealing member capable of unsealing and driving the toner supply container with a simple structure.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, a toner supply container and an unsealing member according to the preferred embodiments of the present invention will be described in conjunction with the accompanying drawings.

(Embodiment 1)

In this embodiment, a toner supply container including a sealing member and a driving force receiving member is used.

Figure 1:
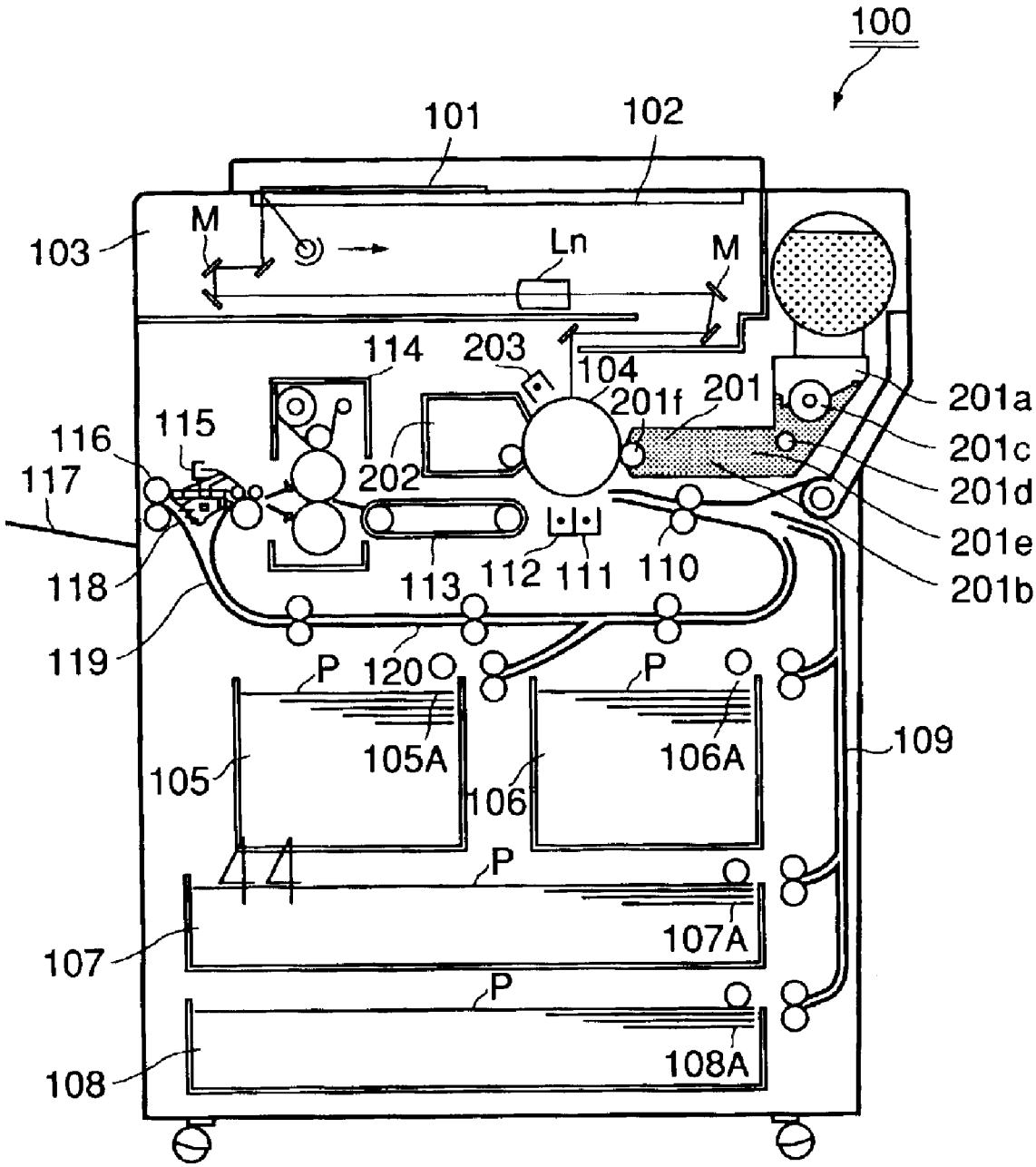
FIG. 1 is a sectional view of an image forming apparatus (electrophotographic copying machine) used in the present invention.

Referring to FIG. 1, the description will first be made as to an electrophotographic copying machine as an example of an electrophotographic image forming apparatus to which a toner supply container according to an embodiment of the present invention.

(Electrophotographic Image Forming Apparatus)

FIG. 1 shows an electrophotographic copying machine. An original 101 in a main body (main body of apparatus) 100 is placed on an original supporting platen glass 102. A light image corresponding to the image information of the original 101 is image on n electrophotographic photosensitive drum (image bearing member) 104 through a plurality of mirrors M and a lens Ln of an optical power 103. On the basis of selection by the user on an operating portion 100*a* shown in FIG. 2 or on the basis of automatic selection in accordance with the paper size of the original 101, an optimum sheet P is selected from the cassettes 105, 106, 107, 108. The recording material is not limited to the sheet of paper, but may be an OH P sheet, for example.

A single sheet P supplied from one of separating devices 105A, 106A, 107A, 108A, is fed to registration rollers 110 by way of a feeding portion 109, and the sheet P is fed to the transfer portion by the registration rollers 110 in synchronism with the rotation of the photosensitive drum 104 and the scanning timing of the optical portion 103. In the transfer portion, a toner image formed on the photosensitive drum 104 is transferred onto the sheet P by the transfer discharger 111. The sheet P now having the transferred toner image is separated from the photosensitive drum 104 by a separation discharger 112.

The sheet P is fed into a fixing member 114 by a feeding member 113. In the fixing member 114, the toner image is fixed on the sheet P by heat and pressure. Thereafter, the sheet P is passed through a discharged sheet reversing member 115 and discharged to a sheet discharge tray 117 by sheet discharging rollers 116 in the case of a one-sided copy mode. In the case of a two-sided copy mode, the sheet P is refed to the registration rollers 110 through sheet refeeding paths 119, 120, under the control of a flapper 118 provided in the discharged sheet reversing member 115. Then, the sheet is fed similarly to the case of the one-sided copy mode, and is finally discharged to the sheet discharge tray 117.

In the case of a superimposed copy mode, the sheet P is temporarily and partly discharged by the sheet discharging rollers 116 through the discharged sheet reversing portion 115. Thereafter, at the timing when the trailing edge of the sheet passes by the flapper 118 while it is still nipped by the sheet discharging rollers 116, the flapper 118 is controlled, and the sheet discharging roller 116 is rotated in the reverse direction, so that it is refed into the main body 100. Thereafter, the sheet is fed to the registration rollers 110 through the sheet refeeding portions 119, 120, and then the sheet is processed similarly to the case of the one-sided copy mode. It is finally discharged to the sheet discharge tray 117.

In the main body 100 of apparatus, there are provided a developing device 201, a cleaning device 202, a primary charger 203 and so on, around the photosensitive drum 104.

An electrostatic latent image is formed by exposing the photosensitive drum 104 uniformly to the image light corresponding to the image information of the original 101 in the optical portion 103. The electrostatic latent image is developed with toner by the developing device 201. In order to supply the toner (developer) into the developing device 201, a toner supply container 1 is detachably mountable by the user into the main body 100 of apparatus.

The developing device 201 comprises a toner hopper 201*a* and a developing device 201*b*. The toner hopper 201*a* is provided with a stirring member 201*c* for stirring the toner supplied from the toner supply container 1. The toner stirred by the stirring member 201*c* is supplied into the developing device 201*b* by a magnet roller 201*d*. The developing device 201*b* comprises a developing roller 201*f* and a feeding member 201*e*. The toner fed from the toner hopper 201*a* by the magnet roller 201*d* is fed to the developing roller 201*f* by the feeding member 201*e*, and is supplied to the photosensitive drum 104 by the developing roller 201*f*.

The cleaning device 202 functions to remove the toner remaining on the photosensitive drum 104. The primary charger 203 functions to electrically charge the photosensitive drum 104.

Figure 2:
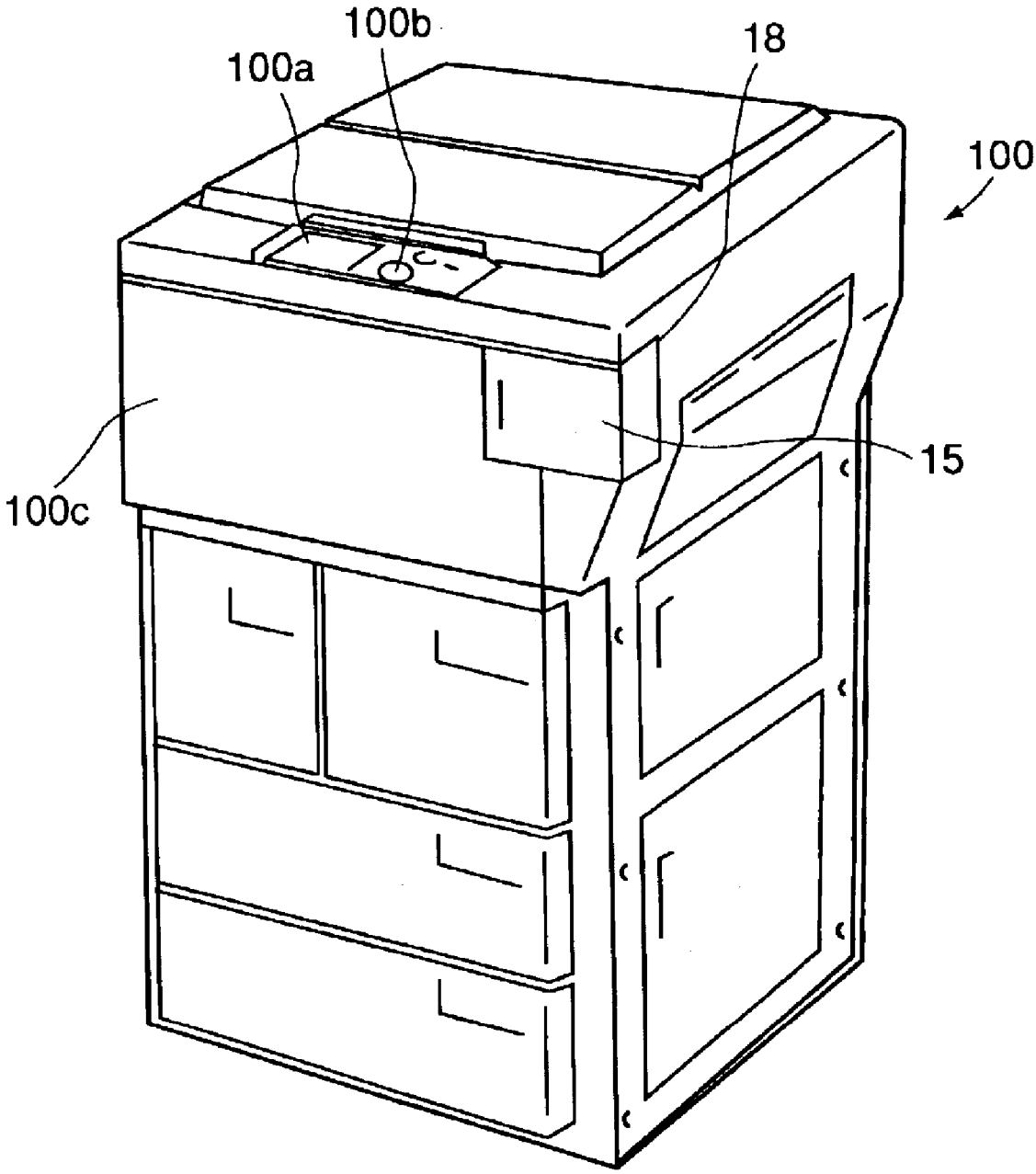
FIG. 2 is a perspective view of the electrophotographic copying machine shown in FIG. 1.
Figure 3:
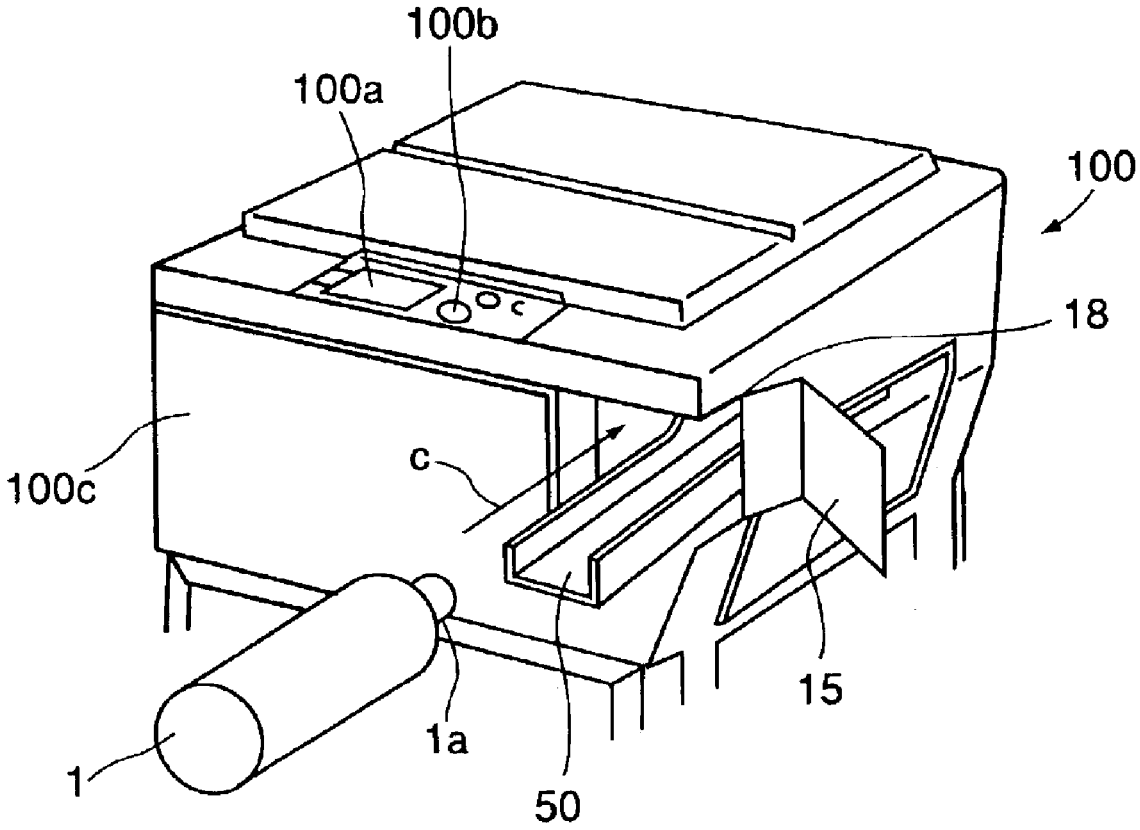
FIG. 3 is a perspective view illustrating mounting of a toner supply container into the electrophotographic copying machine after a toner container exchange cover is opened.

As shown in FIG. 3, when the user opens a front cover 15 for exchange of the toner supply container which is a part of an outer casing shown in FIG. 2, a container receiving tray 50 which is a part of mounting means is drawn out to a predetermined position by an unshown driving system. The user places the toner supply container 1 on the container receiving tray 50. When the user takes the toner supply container 1 out of the main body 100 of the apparatus, the container receiving tray 50 is drawn out, and the toner supply container 1 is taken out of the tray 50.

The front cover 15 is provided exclusively for mounting and demounting (exchange) of the toner supply container 1, and therefore, it is opened and closed only for the purpose. When the maintenance operation for the main body 100 of the apparatus is to be carried out, the front cover 100*c* is opened.

The toner supply container 1 may be directly mounted to the main body 100 of the apparatus without using the container receiving tray 50, and may be taken out.

(Exchanging Method for Toner Supply Container)

Next, a mounting method and a supply operation of the toner supply container of the present invention will be described.

In this embodiment, exchange of the toner supply container 1 is performed by the user in the following manner.

Figure 4:
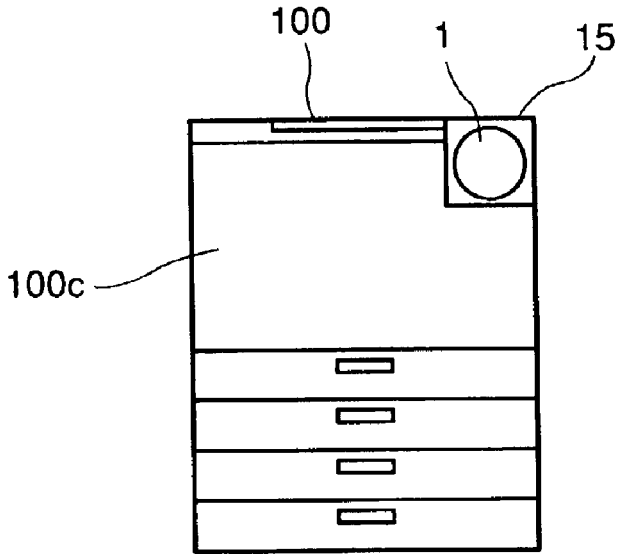
FIG. 4 is a front view of the electrophotographic copying machine of FIG. 1.
Figure 5:
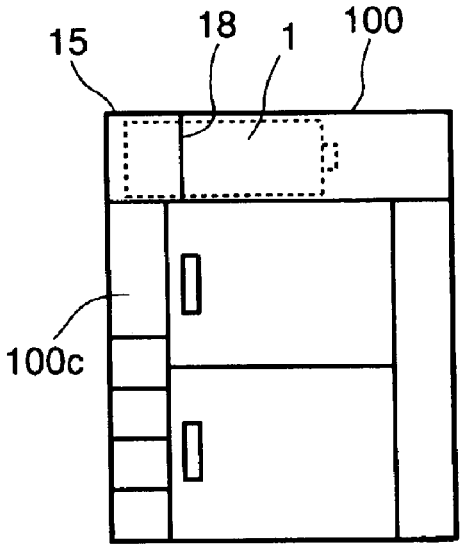
FIG. 5 is a side view of the electrophotographic copying machine of FIG. 1.
Figure 6:
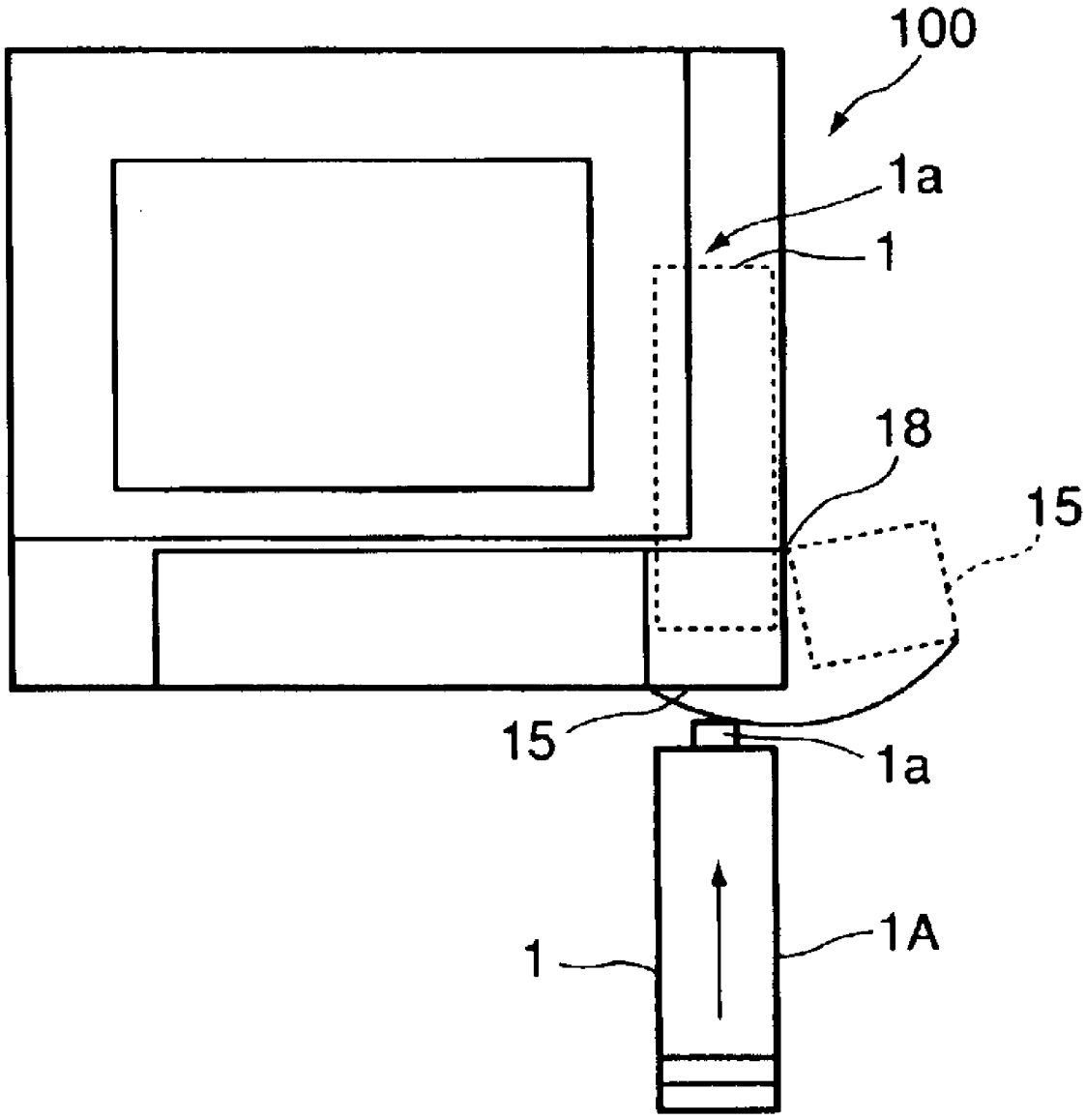
FIG. 6 is a top plan view of the electrophotographic copying machine in which a toner container exchange cover is shown as being in an open position.

First, the front cover 15 which is in the closed state as shown in FIGS. 2, 4 and 5 is rotated about a hinge 18 to an open position indicated by a broken line in FIG. 6 as shown in FIGS. 3 and 6.

Figure 7:
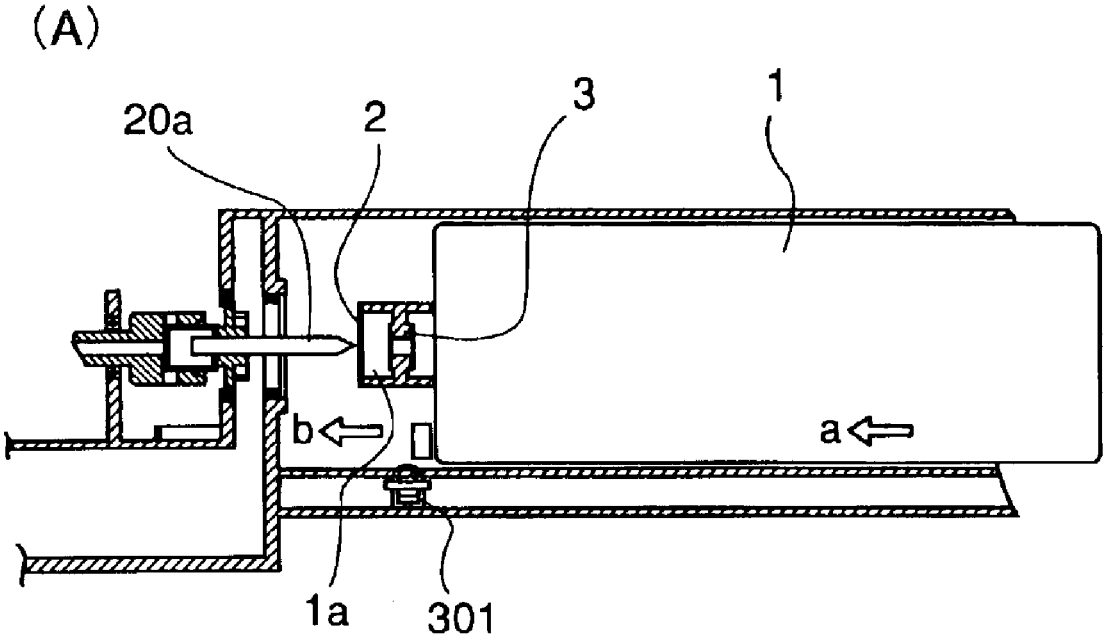
FIG. 7, which consists of FIGS. 7(A) and 7(B), are sectional views illustrating a toner supply container mounting operation, wherein (A) shows initial stage of the mounting operation, (B) shows the state of the mounting operation, (B) shows the state after the completion of the mounting operation, in Embodiment 1 of the present invention.
Figure 7:
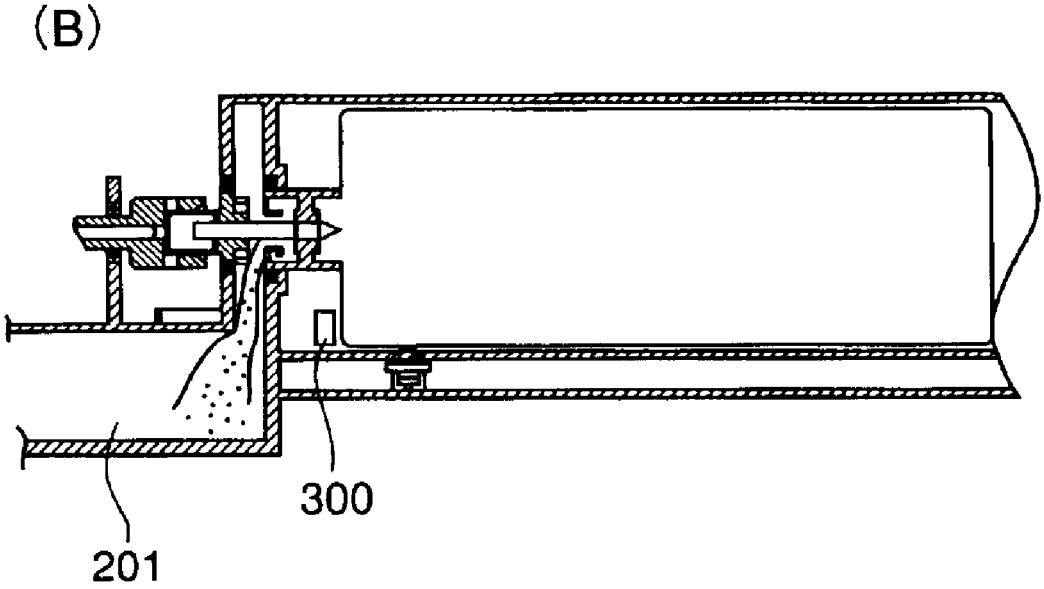

Thereafter, the user inserts a new toner supply container 1 into the apparatus main body 100 in a direction of an arrow a shown in (A) of FIG. 7 which shows a state immediately after the insertion. In this instance, the toner supply container is is provided with an opening 1*a* at a portion (spout) extended from a part of an end face of the toner supply container 1, and the opening 1*a* is sealed with a sealing member 2 of a resin film as a sheet.

Then, the user closes the front cover 15. In interrelation with the action of closing the front cover 15, a sliding member 300 is slided, so that the toner supply container 1 is moved in a direction of an arrow b in (A) of FIG. 7. As a result, the sealing member 2 which seals the opening 1*a* is staved by a staving member 20*a* provided on the apparatus main body side to unseal the opening 1*a*, and an engage hole 3 on the toner supply container 1 side and the staving member 20*a* on the apparatus main body side are engaged with each other to allow driving force transmission.

The staving member 20*a* also functions as a driving force transmitting member and has a cross section having a noncircular shape corresponding to the engage hole 3.

Further, at the time of engagement between the engage hole 3 and the staving member 20*a*, it is necessary to effect (phase) alignment. Means therefor will be described hereinafter.

In the engagement state, when a motor (not shown) is driven, a rotational force (driving force) is transmitted from the staving member 20*a* to the engage hole 3 of the toner supply container 1, thus rotating the toner supply container 1. The toner supply container 1 is rotatably supported by a receiving roller 301, so that the toner supply container 1 is capable of being smoothly rotated even at a slight torque. The receiving roller 301 is disposed at 4 points constituting a saddle for the toner supply container 1. As described above, the toner accommodated in the toner supply container 1 is successively discharged from the opening 1*a* by the rotation of the toner supply container 1, thus permitting supply of the toner into the developing device 201 on the apparatus main body side.

(Toner Supply Container)

The toner supply container 1 used in this embodiment will be explained with reference to FIG. 8.

Figure 8:
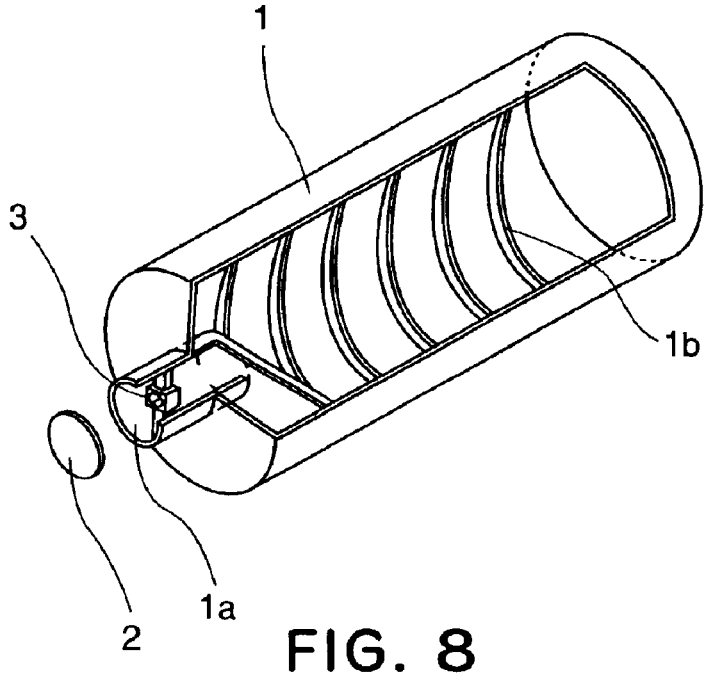
FIG. 8 is a partly broken perspective view showing an internal structure of a toner supply container according to Embodiment 1 of the present invention.

FIG. 8 is a partly broken perspective view of an example of the toner supply container 1 of this embodiment.

The toner supply container 1 is generally cylindrical, and one end thereof is provided substantially at a center with an opening 1*a* by projected portion as a spout. The diameter of the opening 1*a* is smaller than the diameter of the cylindrical portion of the main body of the toner supply container 1. The opening 1*a* is provided with a sealing member 2 for sealing the opening 1*a*, and is unsealed by staving the sealing member 2 with the staving member 20*a*. Inside the sealing member 2, an engage hole 3 or receiving a driving force from the apparatus main body side is provided.

The engage hole 3 is engaged with the staving member 20*a* disposed on the apparatus main body side and functions to transmit the rotational driving force to the toner supply container 1. The structures of the engage hole 3 and the staving member 20*a* will be described in detail hereinafter.

The internal structure of the toner supply container 1 will be described.

As described in the foregoing, the toner supply container 1 is generally cylindrical in shape and is disposed generally horizontally in the main body 100 of apparatus. It is rotated by the main body 100 of apparatus. An inside of the toner supply container 1 has a projection 1*c* in the form of a rib which extends helically. When the toner supply container 1 rotates, the toner is fed in the axial direction along the helical projection 1*c*, and the toner is discharged through the opening 1*a* formed at an end face of the toner supply container 1.

The internal structure of the toner bottle 1 according to the present invention is not limiting, and the configuration or the structure may be any as long as the toner can be discharged by rotation of the toner supply container 1. The main body of the toner supply container is not limited to that described in the foregoing. For example, it may have a feeding member such as a rotation screw or the like for feeding the toner, and the feeding member is driven by a rotational driving force received by the sealing member from the staving member provided to the image forming apparatus main body, while the toner supply container is fixed (not rotatable) on the main body of the image forming apparatus.

The feature of this embodiment is in the structure of the driving force transmitting portion for connection of the sealing member of the toner supply container 1 with the main body 100 of the apparatus with respect to the toner supply container for discharging the toner by driving the toner supply container 1. Therefore, the internal structure of the toner supply container 1 may be any, and the toner supply container may have a helical projection 1*c* on the inner surface of the toner supply container.

Figure 9:
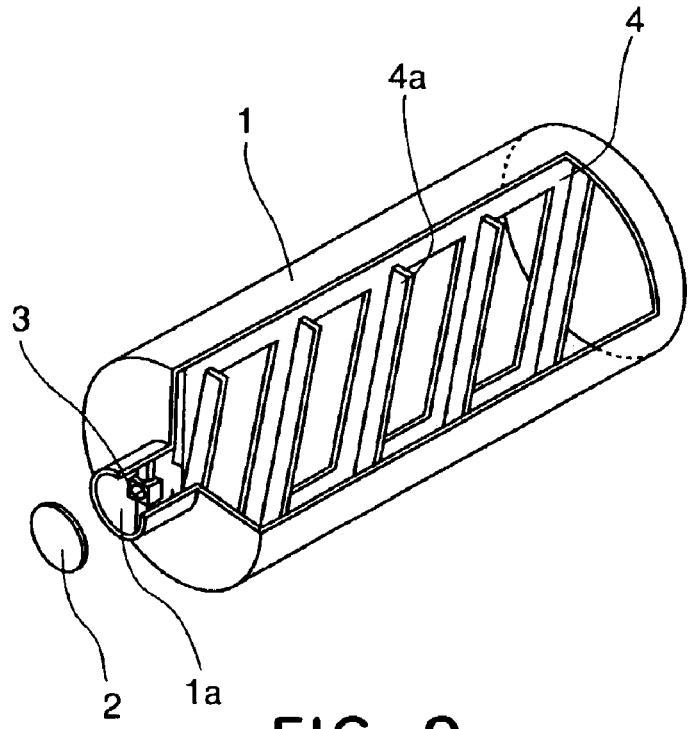
FIG. 9 is a partly broken perspective view showing another part of the internal structure of a toner supply container according to Embodiment 1 of the present invention.

For example, the internal structure of the bottle may be modified as shown in FIG. 9. In this modified example, there is provided in the main body of the toner supply container a baffle member generally in the form of a plate. The surface of the baffle member has, on a surface, a plurality of inclined projections 4*a* which are inclined with respect to the direction of the axis of the toner supply container 1. One end of one of the inclined projections 4*a* extends to a neighborhood of the opening 1*a*. The toner is finally discharged from the inclined projection 4*a* through the opening 1*a*. By the rotation of the toner supply container 1, the toner is scooped by the baffle member 4 and then falls sliding on the surface of the baffle member 4. Because of the inclination of the inclined projections 4*a*, the toner is advanced toward the front side of the toner supply container 1. By repeating this operation, the toner in the toner supply container is gradually fed to the opening 1*a* while being stirred, and is discharged therethrough.

Next, the sealing member 2 will be described in detail with reference to FIG. 10.

Figure 10:
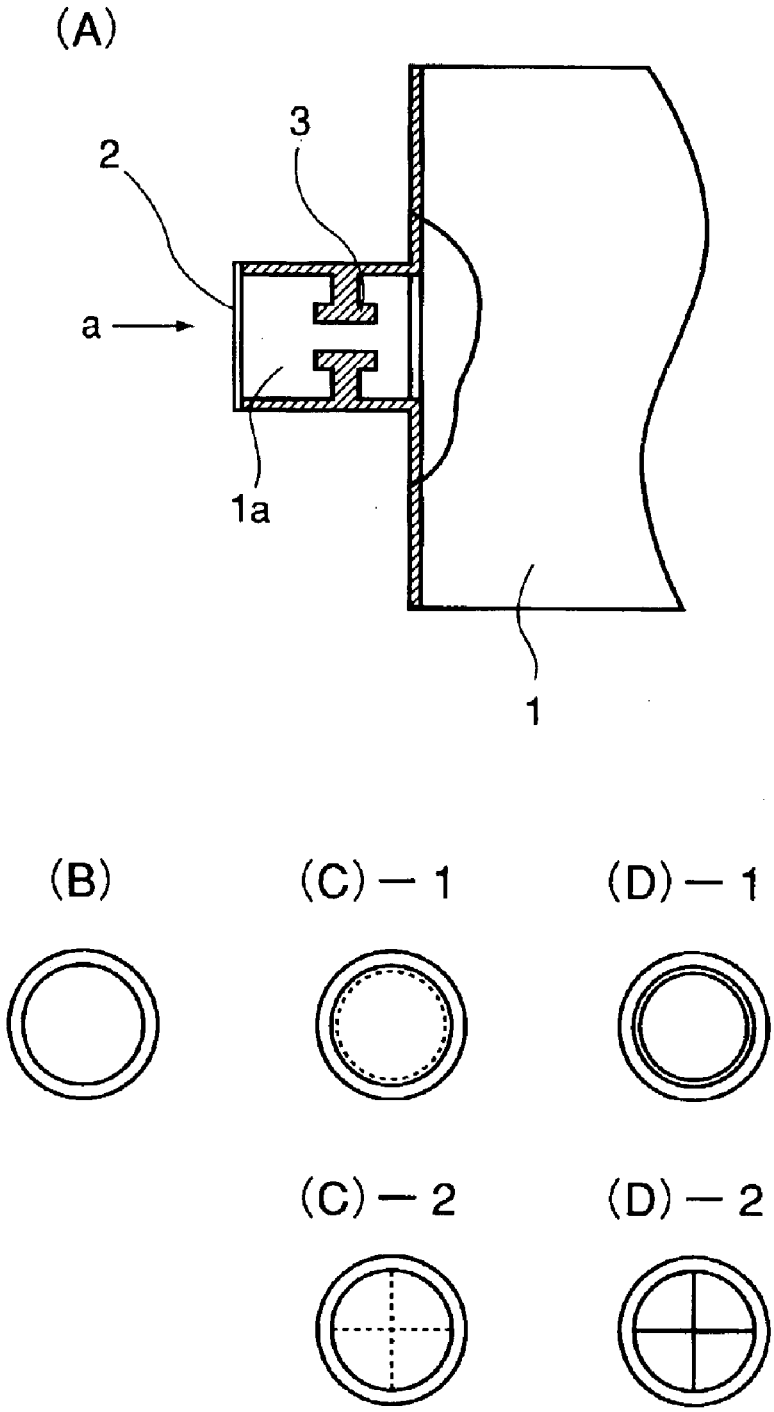
FIG. 10, which consists of FIGS. 10(A) through 10(D), are partly enlarged sections of views of a sealing member 2, wherein (A) is a sectional view of the sealing member in the neighborhood of an opening of a toner supply container according to Embodiment 1 of the present invention, (B) is a side view as seen in a direction a of (A), (C)-1 is a side view showing an example of the sealing member provided with circular perforations, (C)-2 is a side view showing an example of the sealing member provided with a circular half cut portion, (D)-1 is a side view showing an example of the sealing member provided with cross-shaped perforations, and (D)-2 is a side view showing an example of the sealing member provided with a cross-shaped half cut portion.

In FIG. 10, (A) is a sectional view of a portion of the toner supply container 1 in the vicinity of the opening 1*a* for toner supply, and (B) is a side view as seen in a direction of an arrow a of (A).

The sealing member 2 is attached to an end on the opening 1*a* so as to seal the opening 1*a*, and comprises a film which is formed of a material and has a layer structure and a thickness, as shown in Table 2 below.

TABLE 1

| Layer structure | Material* | Thickness |
|---|---|---|
| 1st: surface layer | PET | 16 μm |
| 2nd: support layer | ONy | 25 μm |
| 3rd: cushion layer | LDPE | 30 μm |
| 4th: adhesive layer | EVA | 40 μm |

*PET: polyester film
ONy: biaxially-oriented nylon film
LDPE: low-density polyethylene film
EVA: sealant (ethylene vinyl acetate) film The above-structured sealing member 2 of the four-layered film is cut into a size which is somewhat larger than the opening 1*a* and is applied to the opening 1*a* by a heat sealer for that purpose so as to seal the opening 1*a*.

Further, the sealing member 2 may be provided with an easy cut portion, such as perforations or a half cut portion (provided by partly thinning the film by means of a laser), in order to reduce an unsealing strength. The shapes of the perforations and the half cut portion are not particularly limited but may be, e.g., circular shapes as shown in (C)-1 and (D)-1 of FIG. 10 and cross shapes as shown in (C)-2 and (D)-2 of FIG. 10. In order to reduce the size of a part of the film remaining around the opening 1*a* as small as possible after the sealing member (film) 2 is staved by the staving member 20*a*, the shape of the easy cut portion may preferably be designed to provide a staved cross-sectional area larger than a cross-sectional area of the staving member 20*a* (so as to range a region larger than an area of a portion of the film contacting the staving member 20*a*). As a result, it becomes possible to enlarge a substantial cross-sectional area of the opening 1*a* for permitting discharge of toner as large as possible after the opening 1*a* is unsealed by the staving member 20*a*, and it is possible to enhance a discharge performance.

Figure 11:
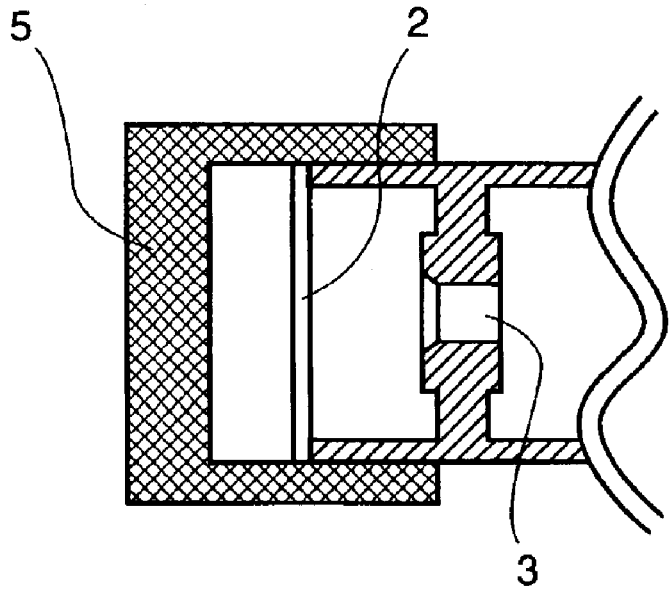
FIG. 11 is a sectional view illustrating mounting of a temporary cap 5 to the opening.

In this embodiment, the film having the sealant (adhesive) layer as a lowermost layer closer to the toner supply container is used as the sealing member. However, in the above-mentioned cases of using the perforations, the half cut portion and the elastic member, it is possible to reduce the unsealing strength but on the other hand, there is possibility that the resultant sealing member is erroneously unsealed in, e.g., a distribution stage to leak toner. For this reason, a temporary cap 5, as shown in FIG. 11, which is mounted to the opening 1*a* immediately before the use of the toner supply container 1 may be used. The temporary cap 5 is press-fitted and fixed at an outer peripheral surface of the opening 1*a*.

Then, the engage hole 3 will be described in detail with reference to FIG. 12.

Figure 12:
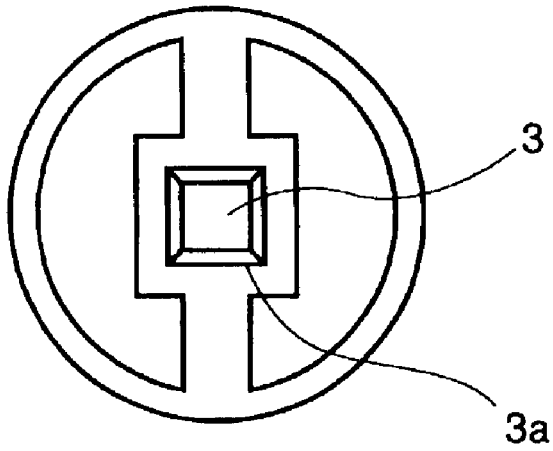
FIG. 12 is a side view showing an engaging hole 3.

FIG. 12 is a side view as seen from the outside (front) of the toner supply container 1.

The engage hole 3 is located substantially in alignment with a central axis line of the opening 1*a* and has a shape corresponding to a driving force transmitting member (the staving member 20*a*) provided to the apparatus main body but is somewhat larger than the staving member 20*a*. In this embodiment, the shape of the staving member 20*a* is intended to represent a sequence pole, thus being a square (rectangle) in cross section. Further, the engage hole 3 is fixed to the toner supply container 1, and the driving force transmitting member disposed on the apparatus main body side is engaged in the engage hole 3, thus permitting transmission of the driving force from the apparatus main body side to the toner supply container 1 to rate the toner supply container 1. As a result, the toner is discharged from the toner supply container 1.

In this embodiment, it is necessary to effect (phase) alignment of the staving member 20*a* (located on the apparatus main body side) with the engage hole 3. Hereinbelow, alignment means therefor will be described.

The toner supply container 1 is provided with a mark at a predetermined position in advance. When all the toner is discharged from the toner supply container 1 and the toner supply container 1 is replaced with new one, the toner supply container 1 can be taken out of the apparatus main body only after the mark is automatically or manually aligned with a certain position. Further, the new toner supply container 1 cannot be inserted into the apparatus main body unless the mark is aligned with the take-out position. In this way, the alignment of the staving member 20*a* with the engage hole 3 is performed.

Further, it is also possible to effect the alignment only by changing a tip shape of the staving member 20*a* from the pyramid shape to a cone shape. By changing the tip shape to the cone shape, during the engagement of the staving member 20*a* in the engage hole 3, the toner supply container 1 or the staving member 20*a* is guided to a position being in phase with the other member and then is rotated, thus effecting the (phase) alignment of the staving member 20*a* and the engage hole 3.

Figure 13:
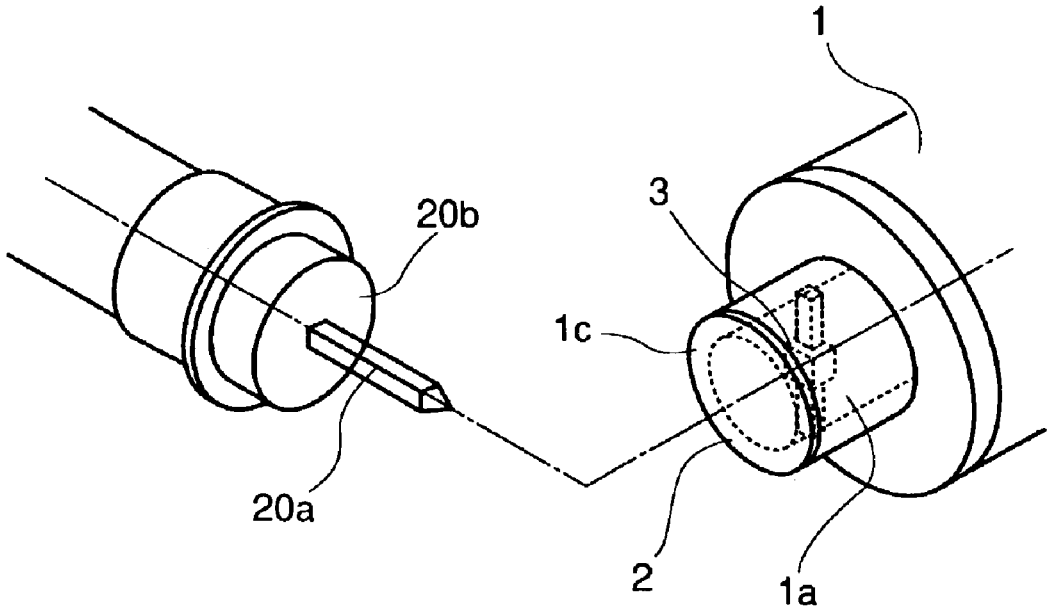
FIG. 13 is a perspective view of a staving member 20*a* and the sealing member 2 according to Embodiment 1 of the present invention.

The staving member 20*a* will be described in detail with reference to FIG. 13.

In this embodiment, as described above, the staving member 20*a* also functions as the driving force transmitting member and is a square pole having a pyramid tip shape. The staving member 20*a* has a length such that an end face 20*b* of the apparatus main body does not contact an opening end face 1*c* even if the staving member 20*a* is engaged in the engage hole 3.

Figure 14:
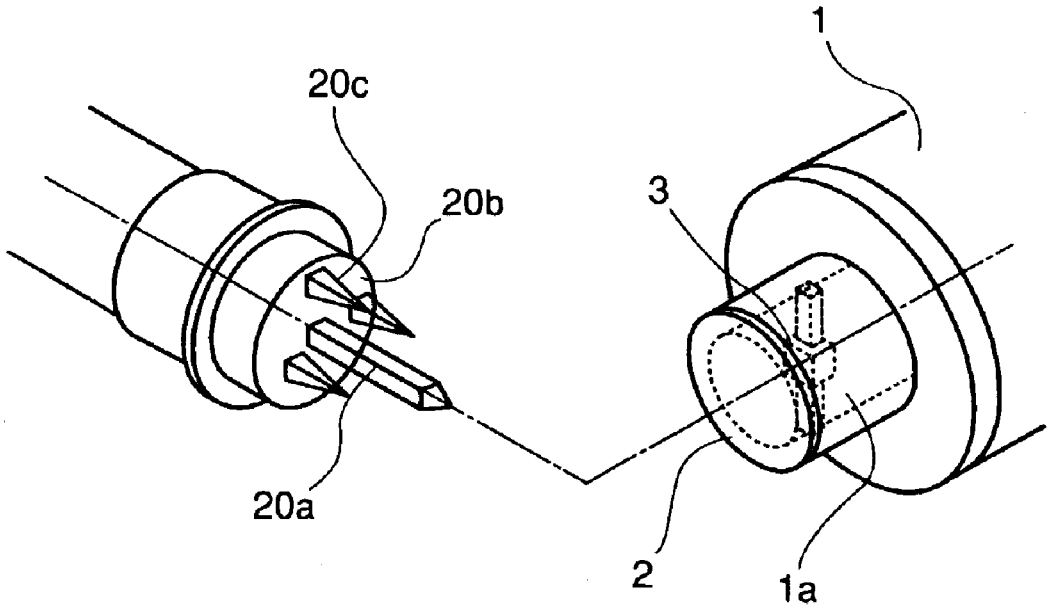
FIG. 14 is a perspective view of a staving member 20*a* provided with an auxiliary staving member 20*c* and the sealing member 2.

Although this embodiment employs a single staving member, the staving member 20*a* may be used in combination with a plurality of auxiliary staving members 20*c* as shown in FIG. 14.

Figure 15:
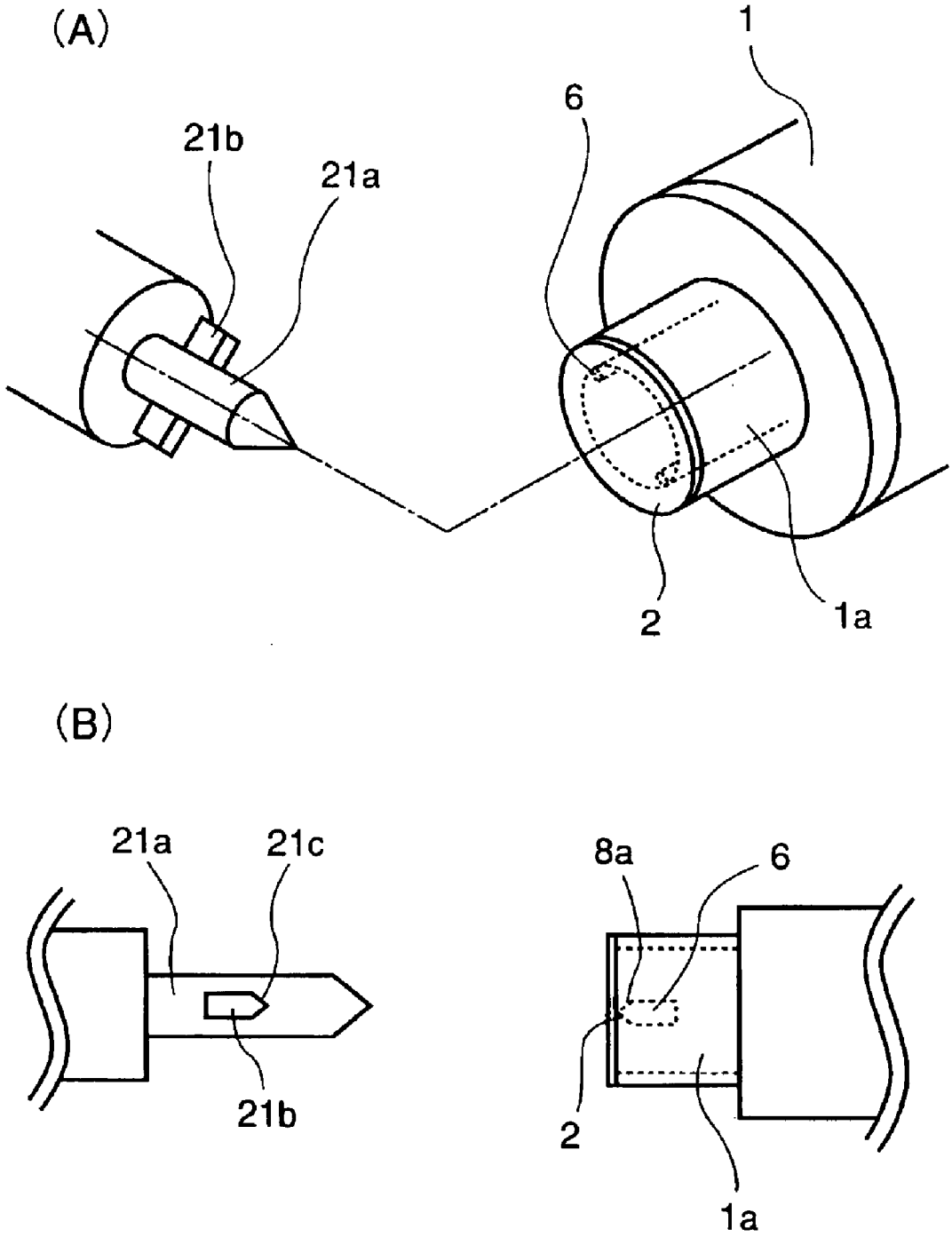
FIG. 15, which consists of FIGS. 15(A) and 15(B), are views of another staving member 21*a* and the sealing member 2, wherein (A) is a perspective view showing another staving member 21*a* provided with a driving force transmitting rib 21*b*, and (B) is a sectional view of the driving force transmitting rib 21*b* having a tapered surface and a driving force receiving rib 6 having a tapered surface.

Further, as shown in (A) of FIG. 15, it is possible to use a staving member 21*a* (which is cylindrical in this case since it is not intended to transmit the driving force) provided with a driving force transmitting rib 21*b*. In this case, a driving force receiving rib 6 corresponding to the driving force transmitting rib 21*b* is provided to the toner supply container 1. In (A) of FIG. 15, in order to eliminate the need for alignment, the driving force transmitting rib 21*b* and the driving force receiving rib 6 have tapered surfaces 21*c* and 6*a* at their tip portions, respectively.

Further, in the case of the structure shown in FIG. 15, it is possible to remove a film, remaining around a discharge port of the opening, which narrows a cross-sectional area for toner discharge, by the driving force transmitting rib 21*b* after the film is staved by the staving member 21*a*. The removal of the film is performed by relative rotation of the driving force transmitting rib 21*b* and the driving force receiving rib 6 until these ribs are engaged with each other at the time of start of rotational drive. In this respect, the structure shown in FIG. 15 is performed compared with those shown in FIGS. 13 and 14. Accordingly, it is preferable that a degree ○ protrusion of the driving force transmitting rib 21*b* from the peripheral surface of the staving member 21*a* is designed to approach an inner diameter of the opening 1*a* as close as possible.

Figure 16:
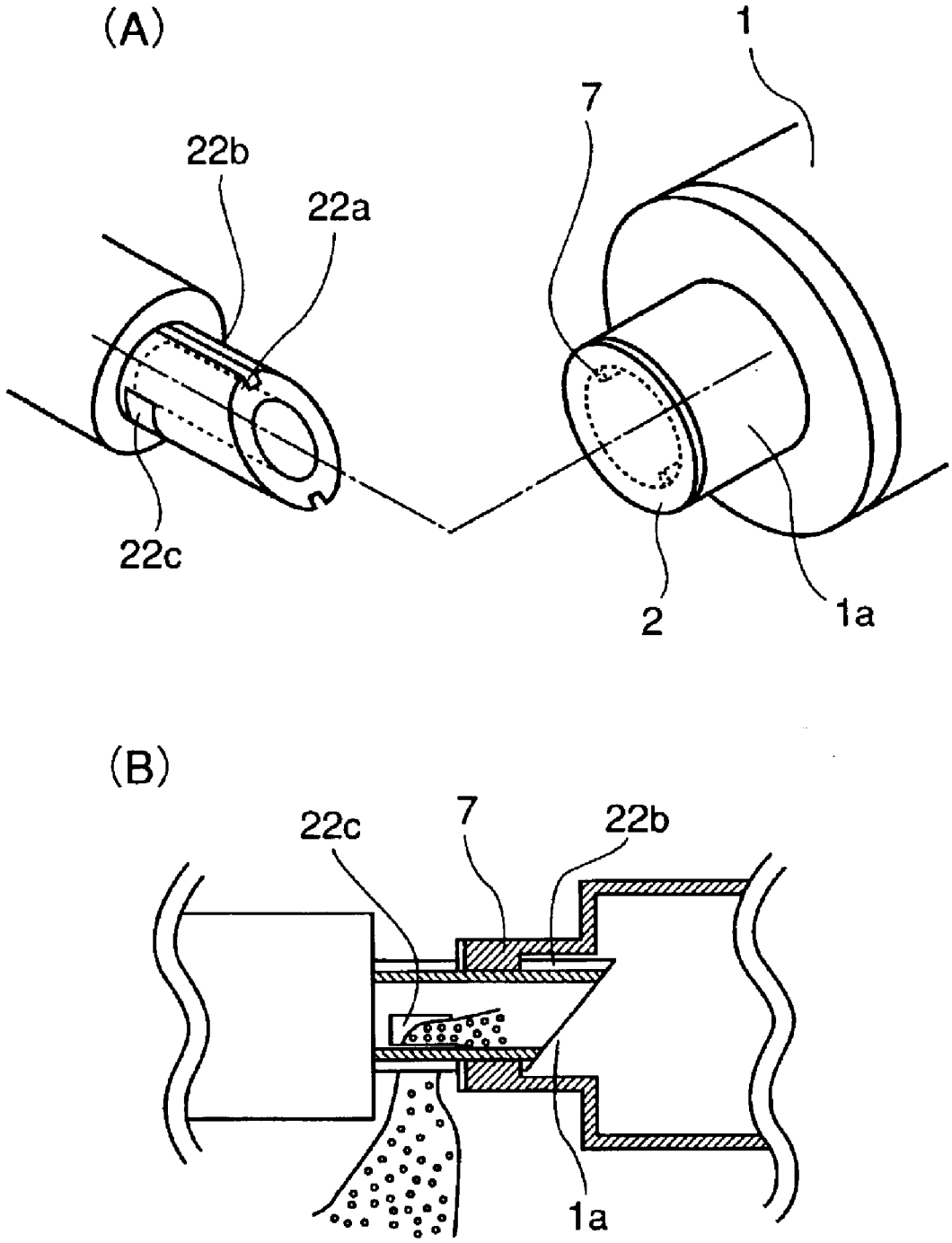
FIG. 16, which consists of FIGS. 16(A) and 16(B), are views of another staving member 22*a* and the sealing member 2, wherein (A) is a perspective view showing another staving member 22*a* provided with a driving force transmitting groove 22*b*, and (B) is a sectional view showing a state such that the sealing member 2 is staved by another staving member 22*a* to unseal the opening, and the driving force transmitting groove 22*b* and a driving force receiving tub 7 are engaged with each other to permit discharge of toner from a through hole 22*c*.

Further, it is also possible to employ a structure such that a pipe-shaped staving member 22*a* is provided with a driving force transmitting groove 22*b* as shown in (A) of FIG. 16. In this case, at the opening 1*a* of the toner supply container 1, a driving force receiving rib 7 is provided. In such a structure, although it is necessary to effect alignment of the driving force transmitting groove 22*b* located on the apparatus main body side with the driving force receiving rib 7 located on the toner supply container side, the driving force transmitting means on the apparatus main body side can be improved in strength, thus leading to a high durability. The pipe-shaped staving member 22*a* is designed to have an outer diameter slightly smaller than an inner diameter of the opening 1*a*. Further, the transmitting member 22*a* is provided with a through hole 22*c* at a portion which does not engage with the opening 1*a* when the toner supply container 1 is mounted to the apparatus main body.

FIG. 16(B) shows a state after the engagement.

Referring to FIG. 16(B), the sealing member 2 is staved to unseal the opening 1*a* and toner passes through the inside of the pipe-shaped staving member 22*a* and is supplied to the apparatus main body through the through hole 22*c*.

Next, a state of engagement of the staving member 20*a* with the engage hole 3 will be described with reference to FIG. 17.

FIG. 17(A) shows a state of the staving member 20*a*, the sealing member 2 and the engage hole 3 when the user opens the front (exchange) cover 15 of the apparatus main body 100 and sets a new toner supply container 1 in the apparatus main body 100. In this state, the staving member 20*a* is located on the front side of the sealing member 2, and the sealing member 2 is still in an unsealed state that the front cover 15 is not yet closed.

FIG. 17(B) shows a state of the staving member 20*a*, the sealing member 2 and the engage hole 3 when the front cover 15 is almost half closed and the toner supply container 1 is almost half closed and the toner supply container 1 is almost half pushed into the apparatus main body by the sliding member 300 shown in FIG. 7. In this state, the sealing member 2 is staved by the staving member 20*a* to unseal the opening 1*a*.

Figure 17:
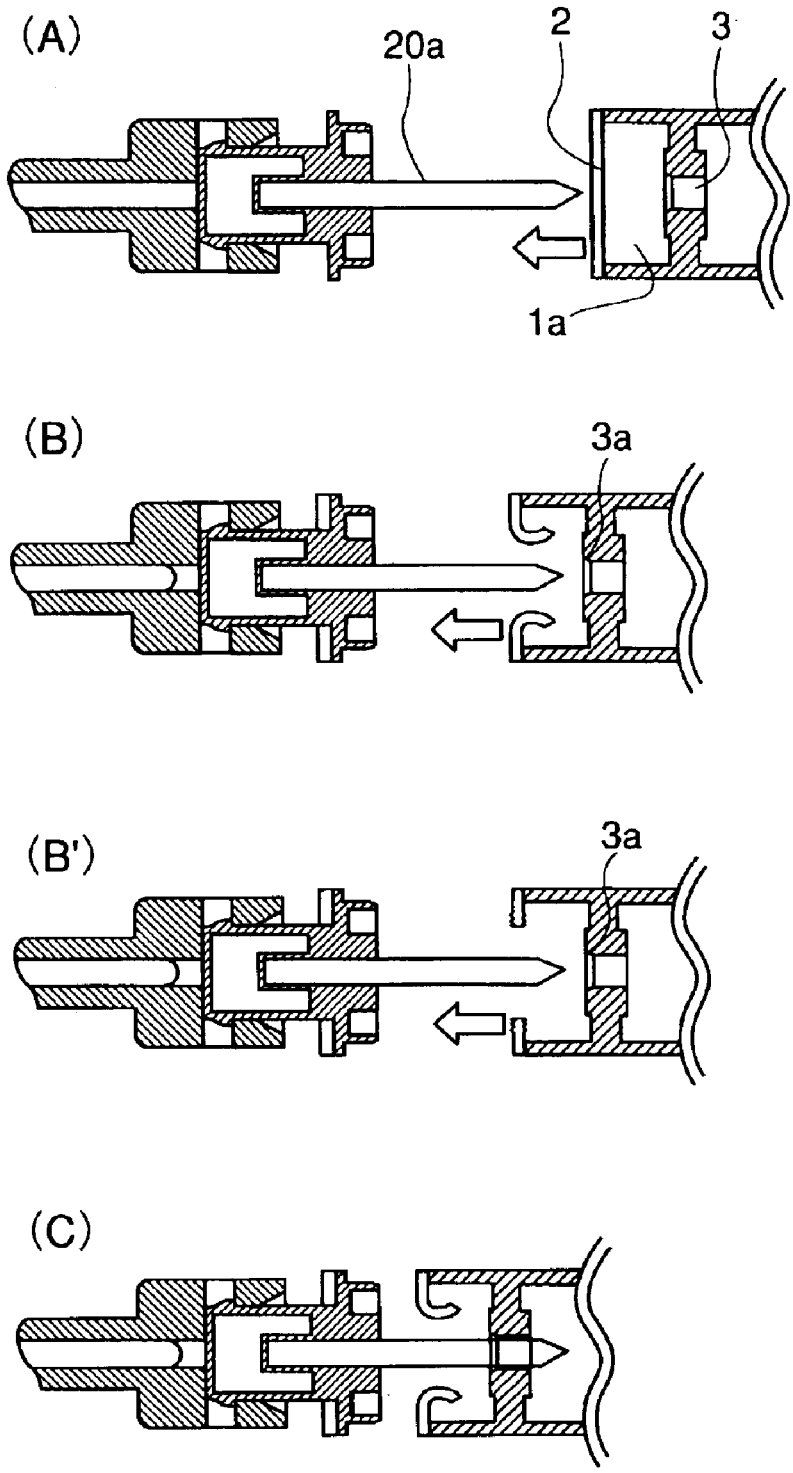
FIG. 17, which consists of FIGS. 17(A) and 17(B), are explanatory sectional views of a state such that the toner supply container according to Embodiment 1 of the present invention is unsealed and the driving force transmitting member and the driving force receiving member are engaged with each other, wherein (A) is a state immediately after mounting of the toner supply container by a user (B) and (B)' are respectively a state that the sealing member 2 is staved by the staving member 20*a* to unseal the opening of the toner supply container, and (C) is a state that the toner supply container is further pushed into an apparatus main body to engage the staving member 20*a* in an engage hole 3.

FIG. 17(B') shows an unsealing state in the case of using an elastic member as the sealing member 2. By the use of the elastic member, the opening 1*a* is unsealed in an area larger than the case of using the sealing member shown in FIG. 17(B). In this way, although a part of the sealing member 2 is staved by the staving member 20*a* in such a state that the elastic film is held under tension, the elastic film as the sealing member 2 is shrunk by the elastic force of the film. Accordingly, the structure shown in (B') of FIG. 17 is particularly preferred in that it is possible to enlarge a substantial cross-sectional area for toner discharge as large as possible.

FIG. 17(C) shows a state of the staving member 20*a*, the sealing member 2 an the engage hole 3 when the front cover 15 is completely closed, and the toner supply container 1 is completely pushed into the apparatus main body by the sliding member 300 shown in (B) of FIG. 7. In this state, the sealing member 2 is staved by the staving member 20*a* to unseal the opening 1*a*, and the staving member 20*a* is completely engaged in the engage hole 3. As shown in (C) of FIG. 17, in such a state that the staving member 20*a* is completely engaged in the engage hole 2, the staving member 20*a* is sufficiently long, so that the opening 1*a* and the end face of the driving force transmitting member of the apparatus main body are sufficiently distant from each other to permit supply of the toner through such a distant region.

As described above, the opening 1*a* is unsealed and the driving force from the apparatus main body can be transmitted to the toner supply container 1, so that the toner supply container 1 is rotated to supply the toner from the toner supply container 1 to the developing device 201 via the unsealed opening 1*a*.

As a result, according to this embodiment, it is possible to prevent such an operation that the toner supply container 1 is driven without accidentally unsealing the sealing member 2.

(Embodiment 2)

This embodiment is identical to Embodiment 1 except that a driving force receiving member is disposed outside the opening 1*a*.

This embodiment will be described in detail with reference to FIGS. 18 and 19.

FIG. 18(A) is a perspective view of a toner supply container 1 provided with an opening 1*a* having a driving force receiving rib 12 at a peripheral surface of the opening 1*a*, and a staving member 25*a* provided with a driving force transmitting rib 25*b*. FIG. 18(B) is a sectional view of such the toner supply container 1 and the staving member 25*a*.

Figure 18:
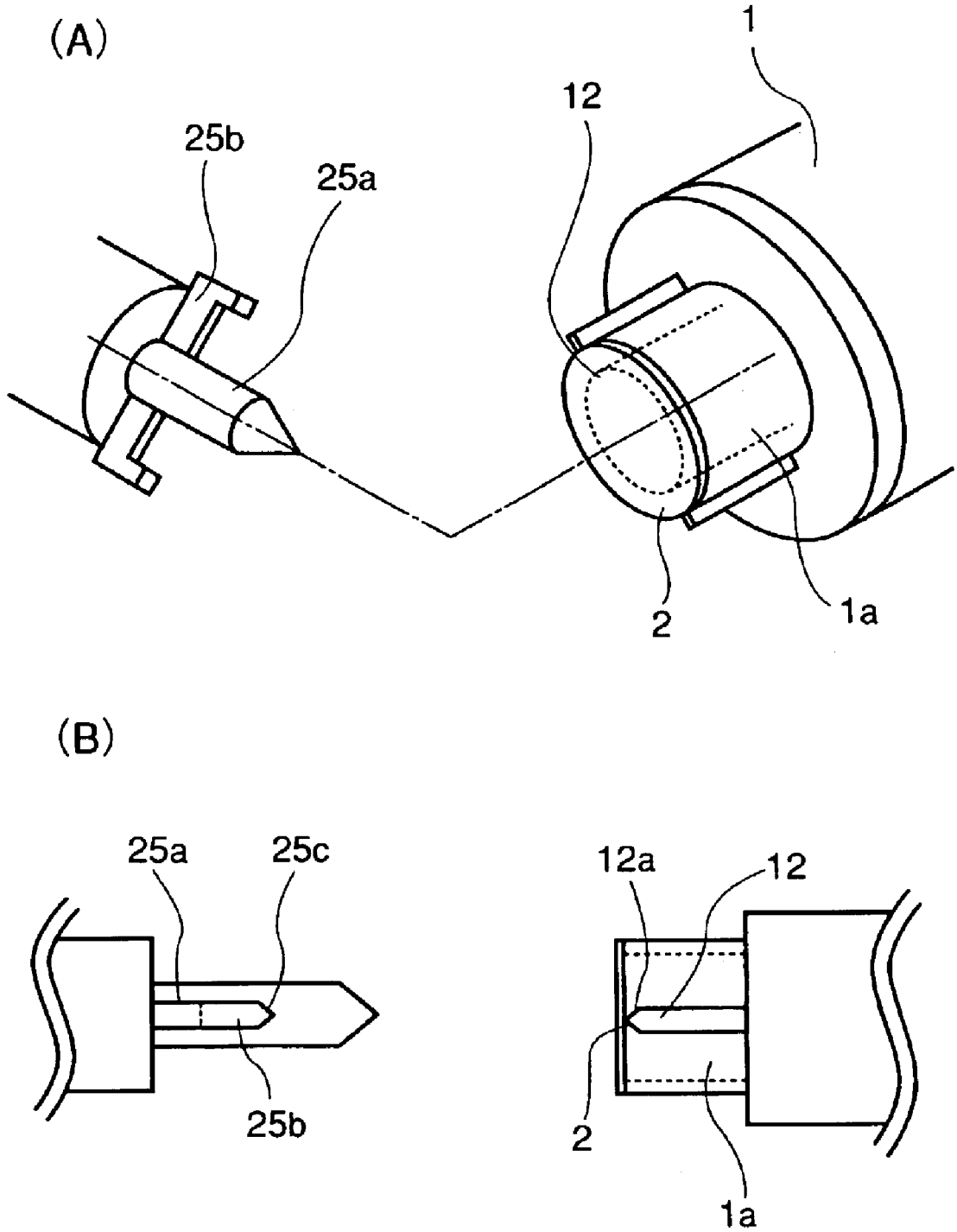
FIG. 18, which consists of FIGS. 18(A) and 18(B), are views showing a staving member 25*a*, a driving force transmitting rib 25*b* and a driving force receiving rib 12 according to Embodiment 2 of the present invention, wherein (A) is a perspective view, and (B) is a front view.

Referring to FIG. 18, in order to eliminate the need for alignment at the time of mounting the toner supply container 1, the driving force transmitting rib 25*b* and the driving force receiving rib 12 are provided with tapered surfaces 25*c* and 6*a* at their tip portions, respectively. Further, in view of the case where the driving force transmitting rib 25*a* and the driving force receiving rib 12 collide with each other to fail in engagement for driving force transmission, a force applied to the staving member or the toner supply container main body so as to be distant from each other. In this case, the driving force transmitting rib is rotationally driven to finally engage with the driving force receiving rib.

In this way, the staving member is designed to engage the opening 1*a* at the outside of the toner supply container, so that it is possible to prevent formation of coarse toner particles at the engagement portion. Further, the driving force transmission is performed at a position distant from the rotation center of the toner supply container in a radial direction, so that torsion of the members is not caused to occur compared with the case of driving force transmission at the rotational center position. As a result, a durability of the constitutional members is improved.

FIG. 19(A) is a perspective view a toner supply container 1 provided with an opening 1*a* having a driving force receiving groove 13, and a staving member 26*a* provided with a driving force transmitting rib 26*b*. FIG. 19(B) is a sectional view of such the toner supply container 1 and the staving member 26*a*.

Figure 19:
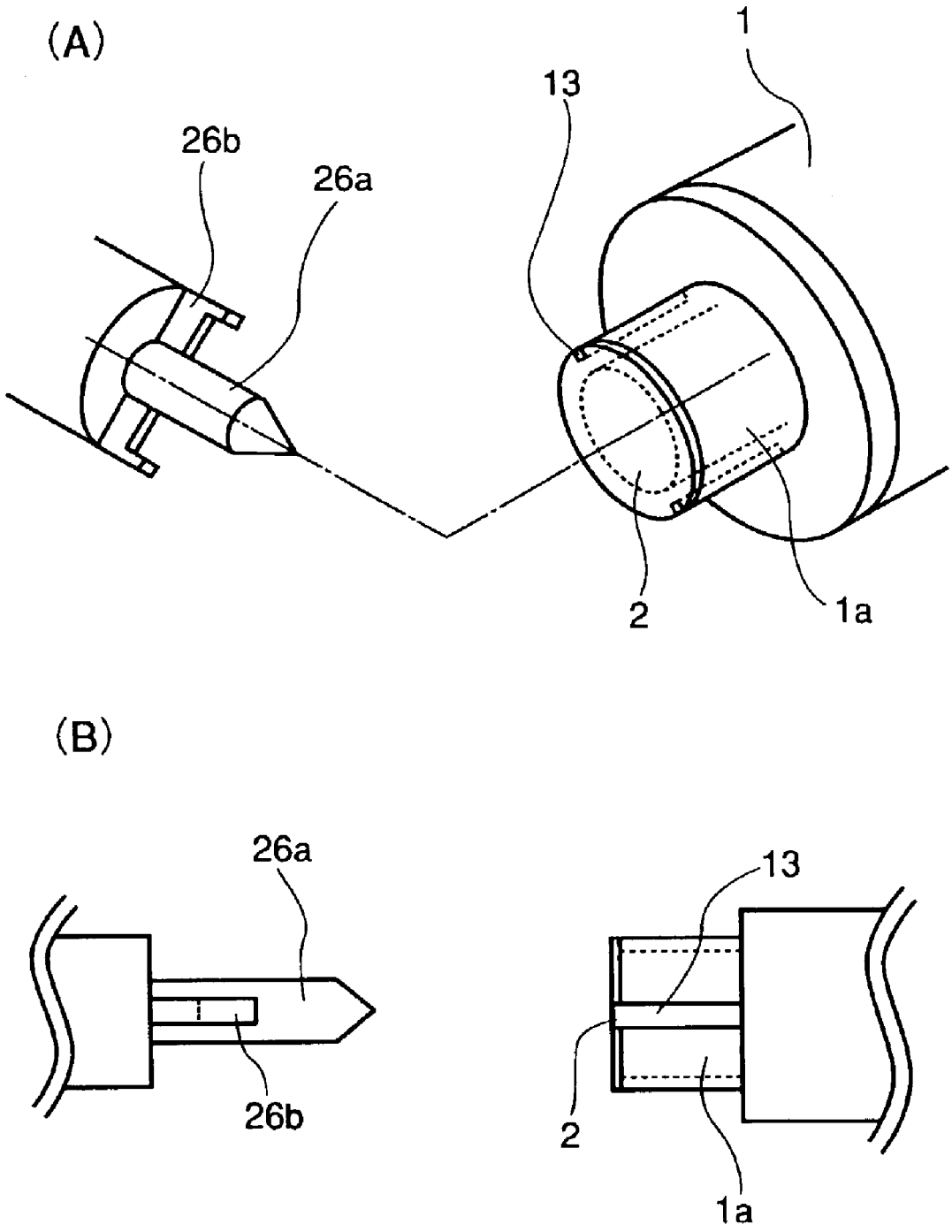
FIG. 19, which consists of FIGS. 19(A) and 19(B), are views showing a staving member 26*a*, a driving force transmitting rib 26*b* and a driving force receiving groove 13 according to Embodiment 2 of the present invention, wherein (A) is a perspective view, and (B) is a front view.

In the structure shown in FIG. 19, it is necessary to use an alignment means at the time of mounting the toner supply container 1. As the alignment means, it is possible to use that employed in Embodiment 1.

In the image forming apparatus body, a state that, in the structure of FIG. 19, the sealing member is staved and the driving force transmitting rib 26*b* is engaged with the driving force receiving groove 13 will be described with reference to FIG. 20.

Figure 20:
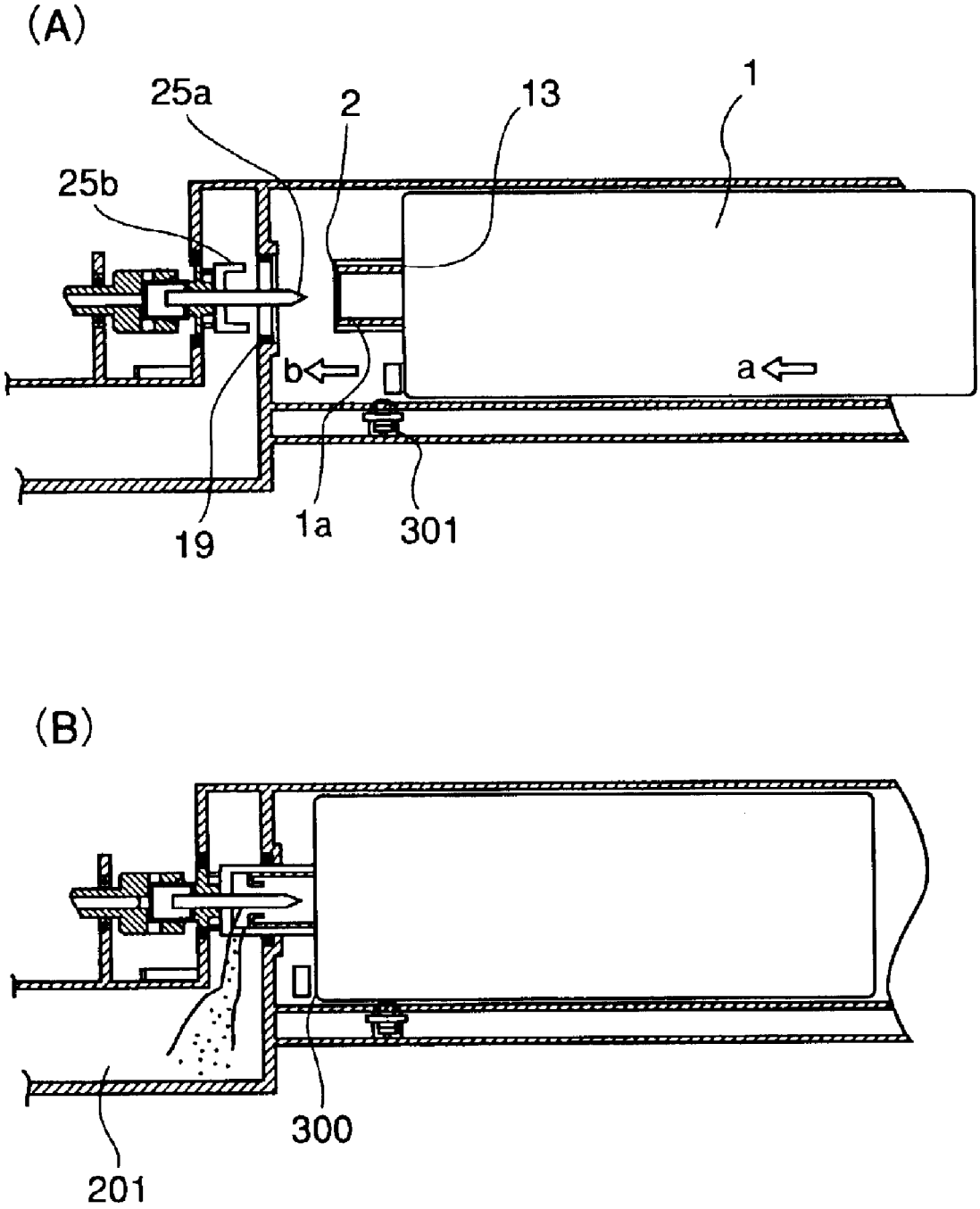
FIG. 20, which consists of FIGS. 20(A) and 20(B), are sectional views illustrating a toner supply container mounting operation, wherein (A) shows an initial stage of the mounting operation, (B) shows the state after the completion of the mounting operation, in Embodiment 1 of the present invention.

First, the user inserts a new toner supply container 1 into the apparatus main body 100 in a direction of an arrow a shown in (A) of FIG. 20. FIG. 20(A) shows a state immediately after the insertion (mounting). As shown in (A) of FIG. 20, at one end face of the toner supply container 1, an opening 1*a* is provided and is in a state sealed by a sealing member 2. Thereafter, the user closes a front (exchanging) cover 15. In interrelation with this closing operation of the front cover 15, a sliding member 300 is slided to move the toner supply container 1 in a direction of an arrow b, thus staving the sealing member 2 with the staving member 26*a* disposed on the apparatus main body side to unseal the opening 1*a*. Then, the driving force receiving groove 13 on the toner supply container side and the driving force transmitting rib 26*a* on the apparatus main body side engage with each other, thus allowing driving force transmission.

In this state, when an unshown motor is driven, a rotational driving force is transmitted from the driving force transmitting rib 26*a* to the driving force receiving groove 13 of the toner supply container 1, thus rotating the toner supply container 1.

Even in the above-mentioned structures shown in FIGS. 18 and 19, similarly as in Embodiment 1, the sealing member 2 sealing the opening 1*a* of the toner supply container 1 is staved with reliability, and then the driving force receiving rib 12 and groove 13 are engaged with the driving force transmitting ribs 25*b* and 26*b*, respectively. As a result, it is possible to prevent such an operation that the toner supply container is driven without accidentally unseal the toner sealing member.

(Embodiment 3)

This embodiment will be described with reference to FIGS. 21 and 22.

Figure 21:
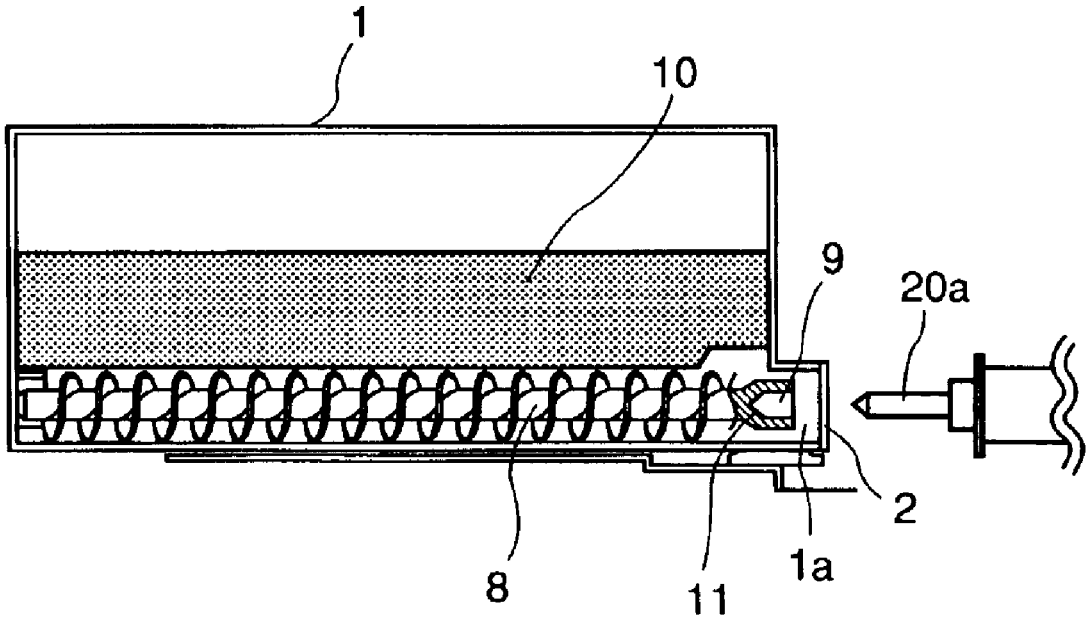
FIG. 21 is a sectional view showing a toner supply container according to Embodiment 3 of the present invention.

This embodiment is characterized in that a feeding member 8 for feeding toner toward an opening 1*a* is provided in a toner supply container 1 as shown in FIG. 21.

The structure of the image forming apparatus main body is identical to Embodiment 1.

FIG. 21 is a sectional view of the toner supply container 1 according to this embodiment.

Referring to FIG. 21, the feeding member 8 is a so-called screw for feeding the toner and the screw is provided with an engage recess 9 at its leading end. Further, the toner supply container 1 also includes a stirring member 10 and similarly as in Embodiment 1, includes an opening 1*a* and a sealing member 2 which seals the opening 1*a*.

The staving member 20*a* on the apparatus main body is identical to that used in Embodiment 1.

A state of engagement of the staving member 20*a* with the engage recess 9 will be described with reference to FIG. 22.

FIG. 22(A) shows a state of the staving member 20*a*, the sealing member (screw) 2 and the engage recess 9 when the user opens the front (exchange) cover 15 of the apparatus main body 100 and sets a new toner supply container 1 in the apparatus main body 100. In this state, the staving member 20*a* locates on the front side of the sealing member 2, and the sealing member 2 is still in an unsealed state that the front cover 15 is not yet closed.

Figure 22:
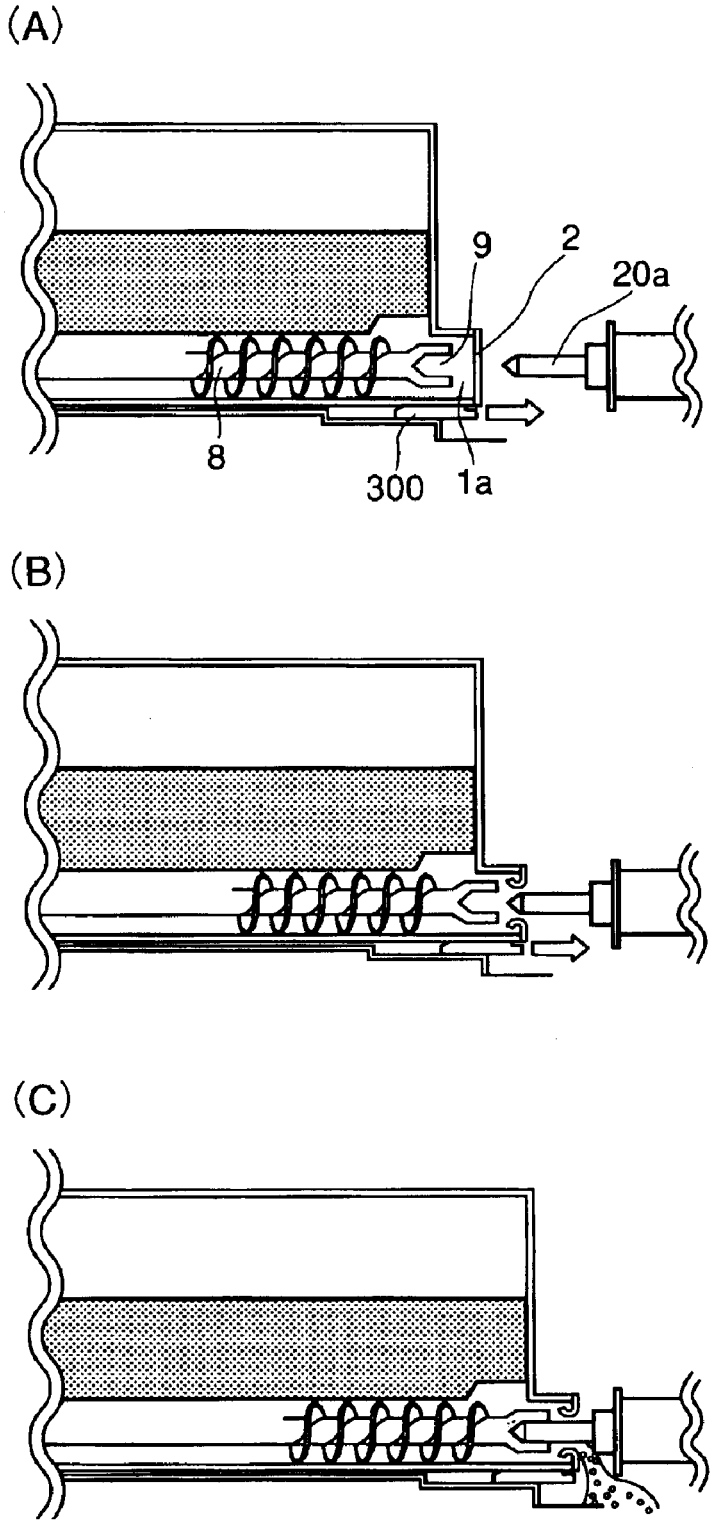
FIG. 22, which consists of FIGS. 22(A) through 22(C), are explanatory sectional views of a state such that the toner supply container according to Embodiment 3 of the present invention is unsealed and the driving force transmitting member and the driving force receiving member are engaged with each other, wherein (A) is a state immediately after mounting of the toner supply container by a user, (B) is a state that the sealing member 2 is staved by the staving member 20*a* to unseal the opening of the toner supply container, and (C) is a state that the toner supply container is further pushed into an apparatus main body to engage the staving member 20*a* in an engage hole 3.

FIG. 22(B) shows a state of the staving member 20*a*, the sealing member 2 and the engage recess 9 when the front cover 15 is almost half closed and the toner supply container 1 is almost half pushed into the apparatus main body by the sliding member 300 as shown in FIG. 22. In this state, the sealing member 2 is staved by the staving member 20*a* to unseal the opening 1*a*.

FIG. 22(C) shows a state of the staving member 20*a*, the sealing member 2 and the engage recess 9 when the front cover is completely closed, and the toner supply container 1 is completely pushed into the apparatus main body by the sliding member 300 shown in FIG. 22. In this state, the sealing member is staved by the staving member 20*a* to unseal the opening 1*a*, and the staving member 20*a* is completely engaged in the engage recess 9. As shown in (C) in FIG. 22, in such a state that the staving member 20*a* is completely engaged in the engage recess 9, the staving member 20*a* is sufficiently long, so that the opening 1*a* and the end face of the driving force transmitting member of the apparatus main body are sufficiently distant from each other to permit supply of the toner through such a distant region.

Incidentally, in order to prevent the toner from filling the engage recess 9, the engage recess 9 is provided with a through hole 11 for permitting escape of the toner therefrom as shown in FIG. 21.

As described above, the opening 1*a* is unsealed, and the driving force is transmitted from the apparatus body side to the feeding member 8 of the toner supply container 1, thus rotating the feeding member 8. As a result, it is possible to supply the toner from the toner supply container 1 to the developing device 201 on the apparatus main body side through the unsealed opening 1*a*.

According to this embodiment, it is possible to prevent the user from accidentally rotating the coupling (engaged) portion, with reliability.

(Embodiment 4)

This embodiment will be described with reference to FIGS. 23–25, which illustrate shapes and structures of a driving force transmitting member provided with a transmitting member.

Figure 23:
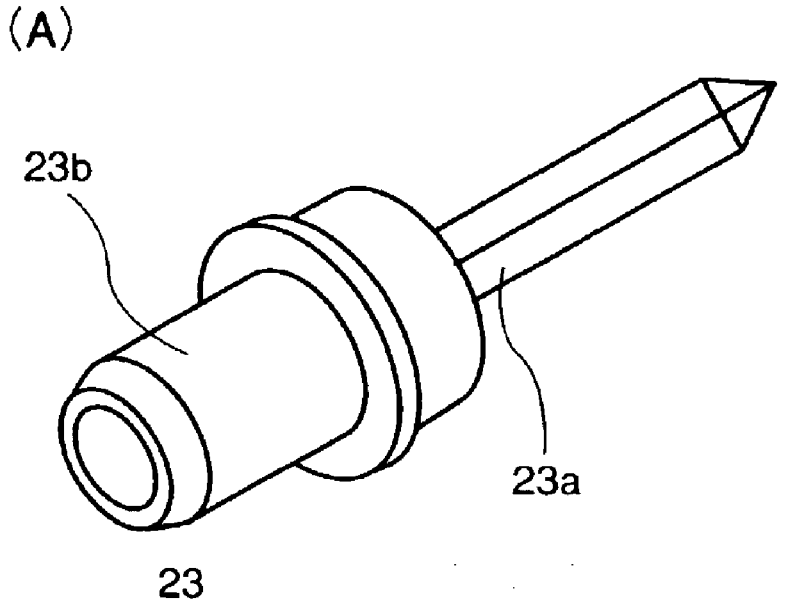
FIG. 23, which consists of FIGS. 23(A) and 23(B), are perspective views of a driving force transmitting portion according to Embodiment 4 of the present invention, wherein (A) is a view showing the driving force transmitting member provided with a mounting portion 23*b*, and (B) is a view showing the driving force transmitting member provided with a slit 24*b* and a mounting rib 24*c*.
Figure 23:
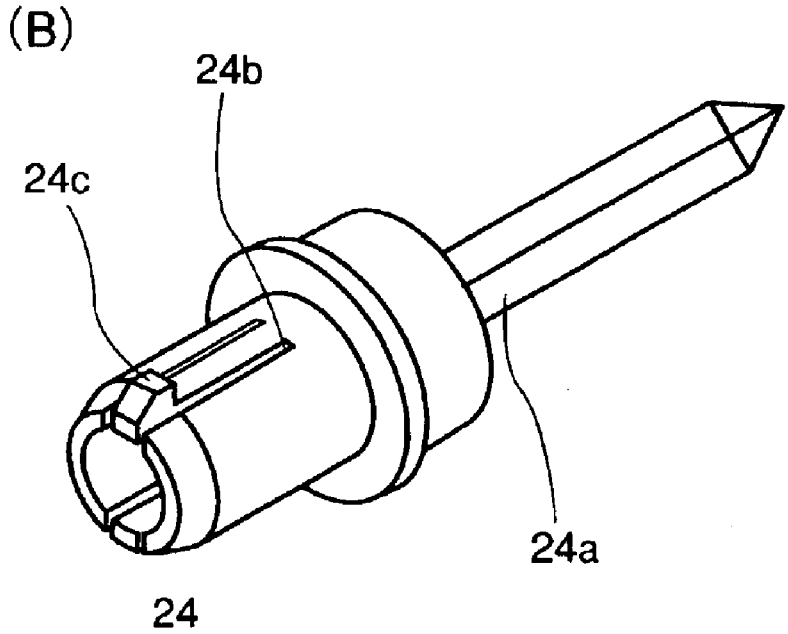

FIG. 23 is a perspective view of driving force transmitting members 23 and 24.

FIG. 23(A) shows the driving force transmitting member 23 includes a starting members 23 and 24.

FIG. 23(A) shows the driving force transmitting member 23 includes a staving member 23*a* and a mounting portion 23*b* for readily detachably mountable to the apparatus main body.

The transmitting member 23*a* is to stave the sealing member 2 which seals the opening 1*a* of the toner supply container 1 used in Embodiments 1 and 2 and to engage with the engage hole 3, thus transmitting the driving force from the apparatus main body to the toner supply container 1.

The mounting portion 23*b* is pressed into a mounting portion 30*a* of the apparatus main body along an inner peripheral surface of the main body-side mounting portion 30*a*, thus being locked in a rotational axis direction and in a rotational direction (FIG. 24(A)).

FIG. 23(B) shows the driving force transmitting member 24 including a staving member 24*a*, a slit 24*b* and a main body mounting rib 24*c*, which form a snap-fit structure.

The staving members 23*a* and 24*a* have the same function as the staving member shown in (A) of FIG. 20.

Referring to (B) of FIG. 23, the main body mounting rib 24*c* can be bent inward (in a central axis direction) and is coupled to a driving portion 30 of the apparatus main body in a snap fitting manner so as to be readily detachable from the driving portion (FIG. 24(B)).

The coupling of the driving force transmitting members 23 and 24 with the driving portions 30 will be described with reference to FIG. 24, wherein (A) is a perspective view corresponding to (A) of FIG. 23, and (B) is a perspective view corresponding to (B) of FIG. 23.

Figure 24:
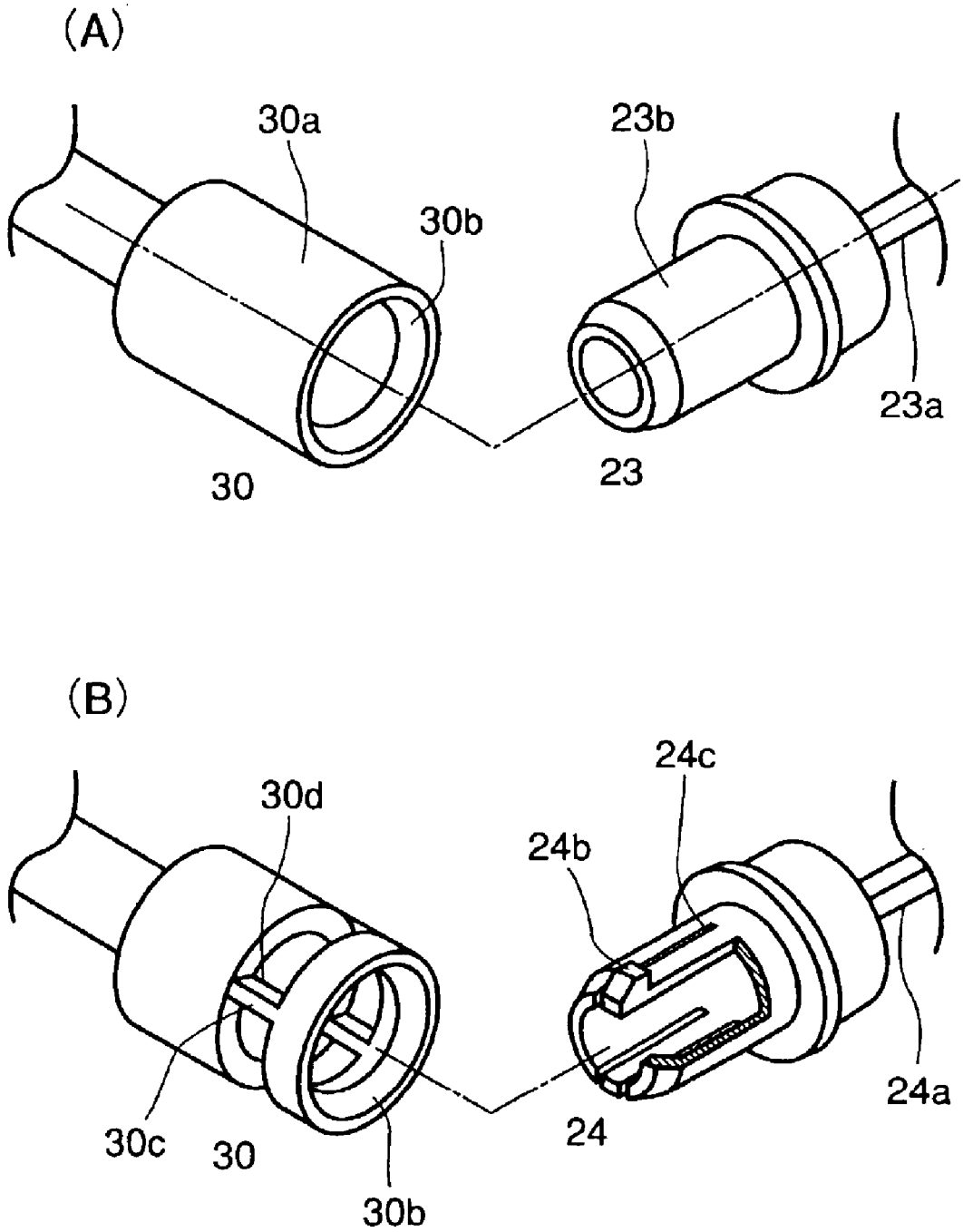
FIG. 24, which consists of FIGS. 24(A) and 24(B), are perspective views of the driving force transmitting member according to Embodiment 4 of the present invention, wherein (A) is a view showing the driving force transmitting member shown in FIG. 23(A) and a drive portion on the apparatus main body side, and (B) is a side view showing the driving force transmitting member shown in FIG. 23 (B) and a drive portion on the apparatus main body side.

Referring to (A) of FIG. 24, the mounting portion 23*b* of the driving force transmitting member 23 in simply pressed and fixed into the mounting portion 30*a* on the apparatus main body side. Further, the main body-side mounting portion is provided with a tapered surface 30*b* at its inner leading end portion, thus allowing smooth coupling.

Referring to (B) of FIG. 24, the driving portion 30 of the apparatus main body has a tapered surface 30*b*, n engage rib 30*c* and an engage portion 30*d*.

A state of mounting the driving force transmitting member 24 into the driving portion 30 will be described in detail with reference to FIG. 25.

FIG. 25(A) shows a state of the driving force transmitting member 24 to be inserted into the driving portion 30 of the apparatus main body so as to set the transmitting member 24 in the driving portion. In this state, the transmitting member 24 is not yet engaged in the driving portion 30 of the apparatus main body.

Figure 25:
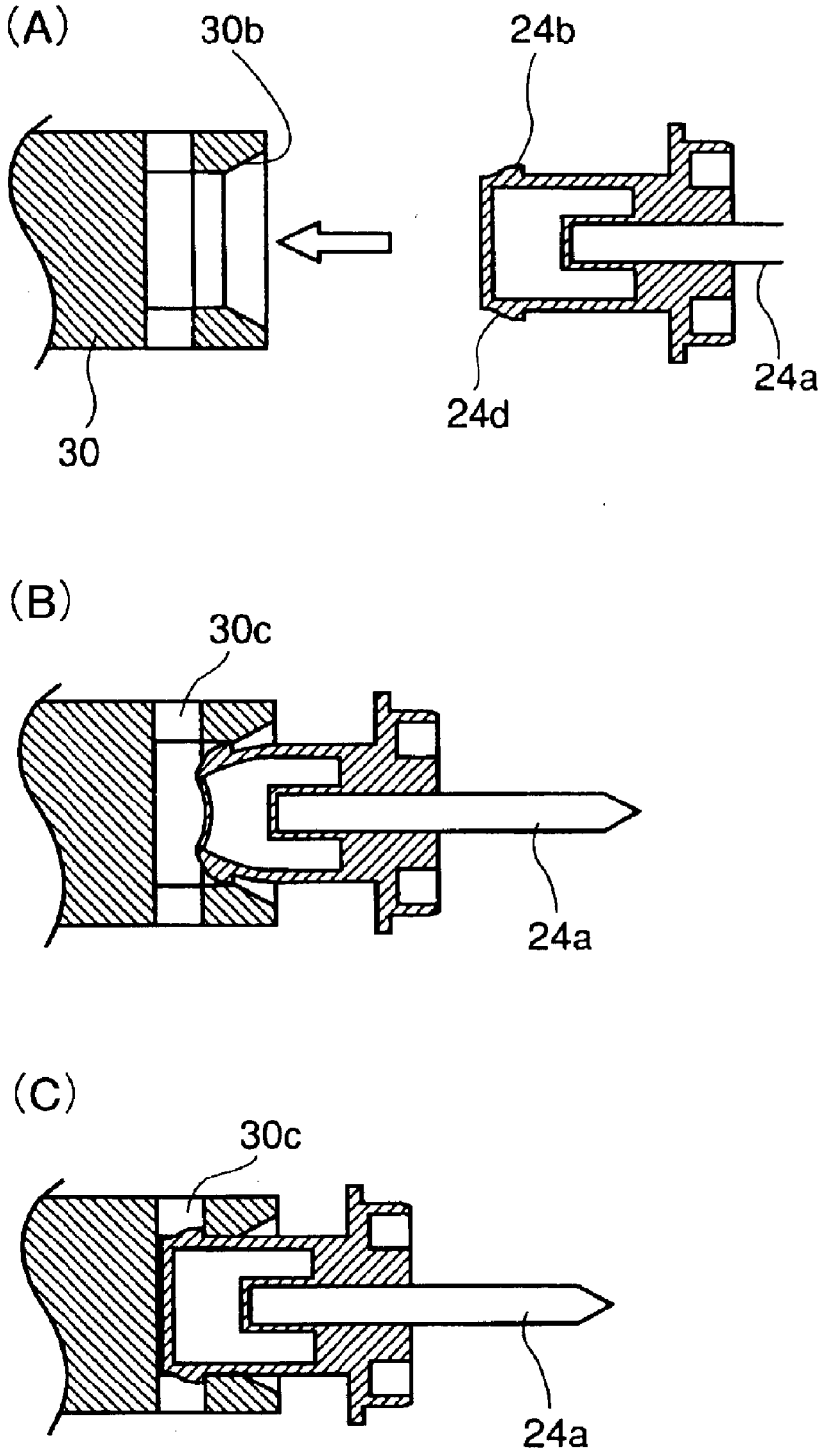
FIG. 25 which consists of FIGS. 25(A) through 25(C) are sectional views illustrating a state such that the driving force transmitting member shown in FIG. 23(B) according to Embodiment 4 of the present invention is mounted and engaged into the drive portion on the apparatus main body side, wherein (A) is a state before engagement (B) is a state that the driving force transmitting member is inserted into the driving portion of the apparatus main body and guided by a tapered surface of the drive portion, thus being elastically deformed to be pushed into the apparatus main body, and (C) is a state where the tapered surface of the drive portion is released at a free space from engage rib 30*c*.

When the driving force transmitting member 24 is further inserted, as shown in (B) of FIG. 25, the mounting rib 24*b* provided to the driving force transmitting member 24 contacts the tapered surface 30*b* and is guided along the tapered surface 30*b* to be elastically deformed and inserted into the driving portion 30 while being gradually bent inward.

When the insertion further proceeds, as shown in (C) of FIG. 25, the bending of the mounting rib 24*b* after passing through a straight portion of the driving portion 30 is released at a space free from the engage rib 30*c*. At the space, the mounting rib 24*b* is placed in a engagement state with the main body-side driving portion 30. In this state, the mounting rib 24*b* is securely engaged in the driving portion 30 to be placed in a state that a position of the mounting rib 24*b* in a thrust (axis) direction. When the apparatus main body-side driving portion 30 is rotated, the driving portion 30 engaged with the driving force transmitting member 24 also in the rotational direction to permit driving force transmission.

In this way, the driving portion of the apparatus main body is fixed with the driving force transmitting member of this embodiment so as to permit driving force transmission, whereby it becomes possible to transmit the driving force from the apparatus main body to the toner supply container.

As described above, the driving force transmitting member provided with the staving member is designed to be readily detachably mountable to the main body of the image forming apparatus, whereby it is possible to simplify the replacement of the toner supply container even if a square shank portion as the driving force transmitting member is rounded with time to fail in good driving force transmission or a sharp tip potion of the driving force transmitting member is blunted with time.

According to the above-described embodiments, the following effects are achieved. It is possible to obviate an operation such that the feeding member of the toner supply container or the container body is driven without accidentally unsealing the toner supply container.

It is possible to reduce the unsealing force by the use of the resin film as the sheet (sealing member). This effect can be further improved by providing the sheet with the easy cut portion. The easy cut portion can enlarge an opening region of the toner discharge port as large as possible.

The sheet exhibits shrinking property when it is staved, so that it becomes possible to enlarge an opening region of the toner discharge port as large as possible. Accordingly, it is possible to stably discharge toner without any obstruction.

What is claimed is:

1. A toner supply container detachably mountable to an image forming apparatus, comprising:

a container body for accommodating toner, said container body having a discharge opening for permitting discharge of the toner;

a sheet for sealing said discharge opening and for being staved by an unsealing member provided in the image forming apparatus; and a rotational force receiving portion, disposed inside said container body and inwardly of said discharge opening, for receiving a rotational force for feeding the toner in said container body toward said discharge opening, wherein after said sheet is staved by the unsealing member, said rotational force receiving portion is coupled with the unsealing member to be placed in a state capable of receiving the rotational force.

2. A container according to claim 1, further comprising a spout extended from a part of an end face of said container body, said spout being provided with said discharge opening at an end portion thereof.

3. A container according to claim 2, wherein said rotational force receiving portion is provided in said spout.

4. A container according to claim 1, further comprising a feeding member for feeding the toner in said container body toward said discharge opening by rotating said container body by the rotational force received by said rotational force receiving portion.

5. A container according to claim 1, further comprising a feeding member for feeding the toner in said container body toward said discharge opening, said feeding member rotating relative to said container body which is non-rotatably held by the image forming apparatus.

6. A container according to claim 1, wherein said sheet is a resin film.

7. A container according to claim 6, wherein said sheet is provided with an easy cut portion.

8. A container according to claim 7, wherein the easy cut portion comprises a perforated or linear recess provided in the resin film.

9. A container according to claim 1, wherein said sheet has a property of being shrunk when the sheet is staved by the unsealing member.

10. An unsealing member, provided to image forming apparatus, for unsealing a toner supply container which comprises a container body for accommodating toner, a discharge opening for permitting discharge of the toner, a sheet for sealing the discharge opening, and a rotational force for feeding the toner in the container body toward the discharge opening, the member comprising:

a staving portion for staving the sheet, which has sealed the discharge opening; and a coupling portion for being coupled with the rotational force receiving portion, located inside the container body and inwardly of the discharge opening, in order to transmit the rotational force to the rotational force receiving portion.

11. A member according to claim 10, wherein said staving portion staves the sheet to unseal the discharge opening and then said coupling portion couples with the rotational force receiving portion.

12. A member according to claim 11, further comprising a bar-shaped portion provided with said staving portion at an end portion thereof, wherein said bar-shaped portion is pointed.

13. A member according to claim 12, wherein said staving portion is disposed so that it is protruded from a peripheral surface of said bar-shaped portion and is capable of being rubbed with the sheet.

14. A member according to claim 12, wherein said bar-shaped portion is provided with a hollow constituting a discharge passage for the toner.

15. A member according to claim 12, wherein said bar-shaped portion has a noncircular cross section corresponding to a shape of a hole provided in the rotational force receiving portion.

16. A member according to claim 10, wherein a plurality of said staving portions are provided.

17. A member according to claim 10, further comprising a snap fit mounting portion for detachably said unsealing member to the image forming apparatus.

* * * * *

UNITED STATES PATENT AND TRADEMARK OFFICE

CERTIFICATE OF CORRECTION

PATENT NO. : 6,980,754 B2
APPLICATION NO. : 10/422977
DATED : December 27, 2005
INVENTOR(S) : Tetsuo Isomura et al.

It is certified that error appears in the above-identified patent and that said Letters Patent is hereby corrected as shown below:

ON THE TITLE PAGE:

UNDER REFERENCES CITED, ITEM (56):

"10020644 A" should read --10-020644 A--.

COLUMN 1:

Line 49, "he" should read --the--.

COLUMN 4:

Line 45, "FIG. 25" should read --FIG. 25,--; and
Line 52, "driving" should read --drive--.

COLUMN 5:

Line 11, "n" should read --an--;
Line 13, "power 103." should read --portion 103.--; and
Line 19, "OH P" should read --OHP--.

COLUMN 6:

Line 47, "is is" should read --is--.

COLUMN 7:

Line 22, "by" should read --by a--.

UNITED STATES PATENT AND TRADEMARK OFFICE

CERTIFICATE OF CORRECTION

PATENT NO. : 6,980,754 B2
APPLICATION NO. : 10/422977
DATED : December 27, 2005
INVENTOR(S) : Tetsuo Isomura et al.

It is certified that error appears in the above-identified patent and that said Letters Patent is hereby corrected as shown below:

COLUMN 11:

Line 11, “2an” should read --2, and--.

COLUMN 12:

Line 24, “slided” should read --slid--; and
Line 44, “unseal” should read --unsealing--.

COLUMN 13:

Line 50, “a” should be deleted; and
Line 53, “for” should read --for being--.

COLUMN 14:

Line 19, “n” should read --an--; and
Line 40, “a’ should read --an--.

COLUMN 16:

Line 7, “to” should read --to an--.

Signed and Sealed this

Eighth Day of August, 2006

JON W. DUDAS
*Director of the United States Patent and Trademark Office*